US011841678B2

(12) United States Patent
Murata et al.

(10) Patent No.: US 11,841,678 B2
(45) Date of Patent: Dec. 12, 2023

(54) TONER PRODUCTION METHOD

(71) Applicant: KAO CORPORATION, Tokyo (JP)

(72) Inventors: Shoichi Murata, Wakayama (JP); Manabu Suzuki, Wakayama (JP); Yuki Wakabayashi, Chiba (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 16/967,324

(22) PCT Filed: Feb. 8, 2019

(86) PCT No.: PCT/JP2019/004696

§ 371 (c)(1),
(2) Date: Aug. 4, 2020

(87) PCT Pub. No.: WO2019/156232

PCT Pub. Date: Aug. 15, 2019

(65) Prior Publication Data

US 2020/0363741 A1 Nov. 19, 2020

(30) Foreign Application Priority Data

Feb. 8, 2018 (JP) ..... 2018-021174
Mar. 1, 2018 (JP) ..... 2018-036346

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 15/08*** | (2006.01) |

(52) U.S. Cl.
CPC ..... *G03G 9/0804* (2013.01); *G03G 9/0819* (2013.01); *G03G 9/08755* (2013.01); *G03G 9/08782* (2013.01); *G03G 9/0904* (2013.01); *G03G 15/08* (2013.01)

(58) Field of Classification Search
CPC .. G03G 9/0802; G03G 9/0804; G03G 9/0819; G03G 9/08755; G03G 9/08782; G03G 9/0904
See application file for complete search history.

(56) References Cited

U.S. PATENT DOCUMENTS

| | | | | |
|---|---|---|---|---|
| 6,991,884 | B2 * | 1/2006 | Sun | G03G 9/08773 430/108.4 |
| 8,956,798 | B2 | 2/2015 | Sata et al. | |
| 2006/0014095 | A1 * | 1/2006 | Sugahara | G03G 9/08728 430/108.8 |
| 2006/0063087 | A1 | 3/2006 | Ninomiya et al. | |
| 2007/0092821 | A1 | 4/2007 | Sato et al. | |
| 2007/0184375 | A1 * | 8/2007 | Ninomiya | G03G 9/09733 430/108.1 |
| 2009/0029282 | A1 * | 1/2009 | Bertelsen | G03G 9/09733 430/137.14 |
| 2010/0055595 | A1 * | 3/2010 | Shirai | G03G 9/0804 430/137.14 |
| 2011/0183249 | A1 * | 7/2011 | Sata | G03G 9/08711 430/105 |
| 2012/0107736 | A1 * | 5/2012 | Jang | G03G 9/0806 977/895 |
| 2013/0183618 | A1 | 7/2013 | Takagi et al. | |
| 2015/0268573 | A1 | 9/2015 | Iwazaki et al. | |
| 2017/0060013 | A1 | 3/2017 | Yoshida et al. | |
| 2017/0060015 | A1 | 3/2017 | Kubo et al. | |
| 2017/0269494 | A1 * | 9/2017 | Yoshida | G03G 9/08755 |
| 2017/0315463 | A1 * | 11/2017 | Onozaki | G03G 9/08704 |

FOREIGN PATENT DOCUMENTS

| | | | |
|---|---|---|---|
| CN | 102262367 | A | 11/2011 |
| CN | 102803339 | A | 11/2012 |
| EP | 1 319 993 | A1 | 6/2003 |
| EP | 1717024 | A1 | 11/2006 |
| JP | 2005-249848 | A | 9/2005 |
| JP | 2005-345861 | A | 12/2005 |
| JP | 2006-91168 | A | 4/2006 |
| JP | 2010-26106 | A | 2/2010 |
| JP | 2013-73086 | A | 4/2013 |
| JP | 2013-130824 | A | 7/2013 |
| JP | 2013-134487 | A | 7/2013 |
| JP | 2013-142709 | A | 7/2013 |

(Continued)

OTHER PUBLICATIONS

English machine translation of the description of JP 2016173405 A (Year: 2022).*
English machine translation of the description of JP 2016136249 A (Year: 2022).*
English machine translation of the description of JP-2016173405-A (Year: 2016).*
English machine translation of the description of JP-2016136249-A (Year: 2016).*
English machine translation of the description of JP-2016173568-A (Year: 2016).*
Extended European Search Report dated Oct. 18, 2021 in European Patent Application No. 19751085.2, 8 pages.

(Continued)

*Primary Examiner* — Peter L Vajda
*Assistant Examiner* — Boone Alexander Evans
(74) *Attorney, Agent, or Firm* — Oblon, McClelland, Maier & Neustadt, L.L.P.

(57) ABSTRACT

A method for producing a toner, including aggregating and coalescing resin particles and colorant particles in an aqueous medium. The resin particles contain, in the same or different particles, an amorphous polyester-based resin which is a polycondensate of an alcohol component containing an aromatic alcohol and a carboxylic acid component, and a crystalline polyester resin. The colorant particles contain a colorant and an addition polymer of a raw material monomer containing an addition-polymerizing monomer having an aromatic group. A ratio by mass of the colorant to the addition polymer in the colorant particles is 50/50 or more and 95/5 or less.

16 Claims, No Drawings

(56) References Cited

FOREIGN PATENT DOCUMENTS

| | | | | | |
|---|---|---|---|---|---|
| JP | 2013-142873 | A | | 7/2013 | |
| JP | 2013-214029 | A | | 10/2013 | |
| JP | 2014-126665 | A | | 7/2014 | |
| JP | 2014-164079 | A | | 9/2014 | |
| JP | 2014-232168 | A | | 12/2014 | |
| JP | 2015-84051 | A | | 4/2015 | |
| JP | 2016-45394 | A | | 4/2016 | |
| JP | 2016-51048 | A | | 4/2016 | |
| JP | 2016-114934 | A | | 6/2016 | |
| JP | 2016136249 | A | * | 7/2016 | ..... C08G 63/20 |
| JP | 2016173405 | A | * | 9/2016 | |
| JP | 2016173568 | A | * | 9/2016 | ..... G03G 9/08 |
| JP | 2017-49404 | A | | 3/2017 | |
| JP | 2017-49581 | A | | 3/2017 | |
| JP | 2017-105952 | A | | 6/2017 | |
| WO | WO 2008/078497 | A1 | | 7/2008 | |

OTHER PUBLICATIONS

International Search Report dated Apr. 2, 2019 in PCT/JP2019/004696 filed on Feb. 8, 2019, 3 pages.

Meng Qinghua et al., "Effect of Colorant on Intrinsic Viscosity of PET Resin", China Plastics, vol. 15, No. 11, Nov. 28, 2001, pp. 60-62 (with Unedited Computer Generated English Translation).

Maryam Ataeefard, "Production of carbon black acrylic composite as electrophotographic toner using emulsion aggregation method: Investigation the effect of agitation rate", Composites: Part B, vol. 64, Aug. 31, 2014, pp. 78-83.

* cited by examiner

TONER PRODUCTION METHOD

FIELD OF THE INVENTION

The present invention relates to a toner production method and a toner to be used for development of latent images that are formed in an electrophotographic method, an electrostatic recording method, an electrostatic printing method, etc.

BACKGROUND OF THE INVENTION

In the field of electrophotography, with the progress of electrophotographic systems, it has been demanded to develop toners for electrophotography which are adaptable for high image quality and high copying or printing speed. As a method for producing a toner having a small particle size and having a narrow particle size distribution in response to high image quality, production of a so-called chemical toner is carried out according to an aggregating and coalescing method (emulsifying and aggregating method, aggregating and unifying method) where fine resin particles are aggregated and coalesced in an aqueous medium to give a toner.

JP 2010-26106 A (PTL 1) describes a method for producing toners for electrophotography that includes a step of mixing a dispersion of colorant-containing polymer particles and a dispersion of substantially colorant-free resin particles to aggregate the colorant-containing polymer particles and the resin particles, wherein the polymer to constitute the colorant-containing polymer particles has (a) a structural unit derived from a salt forming group-containing monomer and (b) a structural unit derived from an aromatic ring-containing monomer. This says that the toner is excellent in colorant dispersibility and can remarkably improve image density.

JP 2016-114934 A (PTL 2) describes a toner for development of electrostatic charge images having a core/shell structure, which contains a binder resin containing a composite resin (A) and a crystalline polyester (B) and a wax in the core part and contains a binder resin containing a polyester resin (C) in the shell part, and wherein the composite resin (A) is a composite resin containing a polyester resin segment (a1) formed through polycondensation of an alcohol component containing a propylene oxide adduct of bisphenol A in an amount of 80 mol % or more and a polycarboxylic acid component, and a vinylic resin segment (a2) containing a styrenic compound-derived structural unit, the crystalline polyester (B) is a crystalline polyester produced through polycondensation of an alcohol component containing an α,ω-aliphatic diol having 8 or more and 16 or less carbon atoms in an amount of 80 mol % or more and a polycarboxylic acid component containing an aliphatic saturated dicarboxylic acid having 8 or more and 16 or less carbon atoms in an amount of 80 mol % or more, and the polyester resin (C) is a polyester resin produced through polycondensation of an alcohol component containing an ethylene oxide adduct of bisphenol A in an amount of 80 mol % or more and a polycarboxylic acid component. This says that the toner satisfies both excellent low-temperature fixing property and heat-resistant storability and is excellent also in electrostatic property.

SUMMARY OF THE INVENTION

The present invention relates to the following [1] and [2].

[1] A method for producing a toner, including a step of aggregating and coalescing resin particles and colorant particles in an aqueous medium, wherein:

the resin particles contain, in the same or different particles, an amorphous polyester-based resin being a polycondensate of an alcohol component containing an aromatic alcohol and a carboxylic acid component, and a crystalline polyester resin, the colorant particles contain a colorant and an addition polymer of a raw material monomer containing an addition-polymerizing monomer having an aromatic group, and the ratio by mass of the colorant to the addition polymer in the colorant particles is 50/50 or more and 95/5 or less.

[2] A toner containing toner particles that contain an amorphous polyester-based resin, a crystalline polyester resin, an addition polymer and a colorant, wherein:

the amorphous polyester-based resin is a polycondensate of an alcohol component containing an aromatic alcohol and a carboxylic acid component, the addition polymer is an addition polymer of a raw material monomer containing an addition-polymerizing monomer having an aromatic group, and the ratio by mass of the colorant to the addition polymer is 50/50 or more and 95/5 or less.

DETAILED DESCRIPTION OF THE INVENTION

A toner capable of attaining a further higher image density even when the amount thereof to be used is smaller than in the methods of PTLs 1 and 2 is desired. From the viewpoint of production methods, a production method capable of producing a toner at a high yield is desired owing to the demand for resource saving.

The present invention relates to a method for producing a toner capable of providing a high image density at a high yield, and to a toner obtained by the production method.

The present inventors have found that, by combining resin particles containing a specific amorphous polyester-based resin and a crystalline polyester resin, and colorant particles containing a specific addition polymer, the image density can be increased and further the yield of the toner in production thereof can be improved.

[Toner Production Method]

The method for producing a toner of the present invention includes a step of aggregating and coalescing resin particles and colorant particles (hereinafter may be referred to as "colorant particles Z") in an aqueous medium.

The resin particles contain, in the same or different particles, an amorphous polyester-based resin being a polycondensate of an alcohol component containing an aromatic alcohol and a carboxylic acid component (hereinafter may be simply referred to as "resin A"), and a crystalline polyester resin (hereinafter may be simply referred to as "resin B").

The colorant particles Z contain a colorant and an addition polymer of a raw material monomer containing an addition-polymerizing monomer having an aromatic group (hereinafter may be simply referred to as "addition polymer E").

The ratio by mass of the colorant to the addition polymer in the colorant particles is 50/50 or more and 95/5 or less.

According to the above-mentioned production method, a toner capable of providing a high image density can be obtained at a high yield.

In producing toner particles containing a crystalline polyester resin according to an emulsifying and aggregating method, there is a problem that the yield of the toner is lowered. It is considered that the reason may be because a crystalline polyester resin and colorant particles have a relatively high affinity and therefore in aggregation and coalescing, there may often occur local aggregation of the crystalline polyester resin and the colorant particles to cause deposition on wall surfaces of production reactors or stirring blades (coarse particles).

In the present invention, the production method for a toner includes a step of aggregating and coalescing resin particles containing a crystalline polyester resin and colorant particles in an aqueous medium, wherein a dispersion of colorant particles containing a colorant and an addition polymer E of a raw material monomer containing an addition-polymerizing monomer having an aromatic group is used in combination. Containing the addition polymer E, it is presumed that the dispersion stability of the colorant particles can improve and the affinity with the crystalline polyester resin can lower to prevent local aggregation, and therefore the yield of the toner particles can be improved.

Further in the present invention, the resin particles contain, in the same or different particles, an amorphous-based polyester resin being a polycondensate of an alcohol component containing an aromatic alcohol and a carboxylic acid component, and a crystalline polyester resin. The site derived from the aromatic alcohol in the amorphous polyester-based resin and the aromatic group site in the addition polymer in the colorant particles can readily interact with each other, and therefore the dispersibility of the colorant in the amorphous polyester-based resin improves. Consequently, the dispersibility of the colorant in the resultant toner may also improves to thereby improve the image density of prints.

Definitions of various terms in this description are mentioned below.

Whether or not a resin is crystalline or amorphous can be determined by the crystallinity index of the resin. The crystallinity index is defined by a ratio of a softening point of a resin to a temperature at the endothermic maximum peak thereof (softening point (° C.)/endothermic maximum peak temperature (° C.)) in the measurement method described in the section of Examples given hereinunder. A crystalline resin is one having a crystallinity index of 0.6 or more and 1.4 or less. An amorphous resin is one having a crystallinity index of less than 0.6 or more than 1.4. The crystallinity index can be appropriately controlled by controlling the production conditions including the kind and the ratio of the raw material monomer, the reaction temperature, the reaction time and the cooling speed.

Regarding the hydrocarbon group, a parenthesized expression of "(iso or tertiary)" and "(iso)" means both a case with the prefix and a case without the prefix, and the case without the prefix indicates normal.

"Aromatic alcohol" means a compound having an aromatic group and having an alcoholic hydroxy group but not a phenolic hydroxy group.

"Aromatic diol" means a compound having two phenolic hydroxy groups directly bonding to an aromatic group. "Aromatic polyol" means a compound having plural phenolic hydroxy groups directly bonding to an aromatic group.

"(Meth)acrylic acid" means at least one selected from acrylic acid and methacrylic acid.

"(Meth)acrylate" means at least one selected from acrylate and methacrylate.

"(Meth)acryloyl group" means at least one selected from an acryloyl group and a methacryloyl group.

"Styrenic compound" means an unsubstituted or substituted styrene.

"Main chain" means a relatively longest bonding chain in an addition polymer.

A method for producing a toner of one embodiment of the present invention includes, for example, a step of aggregating resin particles having, in the same or different particles, a resin A and a resin B, and colorant particles Z in an aqueous medium to give aggregated particles (hereinafter may be referred to as "step 1"), and a step of coalescing the aggregated particles in an aqueous medium (hereinafter may be referred to as "step 2").

Hereinunder the present invention is described with reference to the embodiment as an example.

<Step 1>

In the step 1, resin particles having, in the same or different particles, a resin A and a resin B, and colorant particles Z in an aqueous medium to give aggregated particles. In the step 1, wax and any other additive may also be aggregated in addition to the resin particles and the colorant particles Z.

In the step 1, the resin particles may be any of resin particles X containing a resin A, resin particles Y containing a resin B, and resin particles XY containing a resin A and a resin B in the same particles, but preferably resin particles X containing a resin A and resin particles Y containing a resin B are used in combination.

[Resin A]

The resin A is, from the viewpoint of obtaining a toner capable of providing a high image density at a high yield, an amorphous polyester-based resin being a polycondensate of an alcohol component containing an aromatic alcohol and a carboxylic acid component.

Examples of the amorphous polyester-based resin include a polyester resin, and a modified polyester resin. Examples of the modified polyester resin include an urethane-modified polyester resin, an epoxy-modified polyester resin, and a composite resin containing a polyester resin segment and a vinylic resin segment. Among these, a composite resin is preferred.

The composite resin contains, for example, a polyester resin segment being a polycondensate of an alcohol component containing an aromatic alcohol and a carboxylic acid component, an addition polymer resin segment being an addition polymer of a raw material monomer containing a styrenic compound, and a structural unit derived from a bireactive monomer bonding to the polyester resin segment and the addition polymer resin segment via a covalent bond.

The resin A preferably further contains a structural unit derived from a hydrocarbon wax (W1) having at least any of a carboxy group and a hydroxy group, from the viewpoint of more improving image density.

The resin A is preferably amorphous.

Examples of the aromatic alcohol include an alkylene oxide adduct of an aromatic diol, and an alkylene oxide adduct of a trihydric or higher polyol.

The amount of the aromatic alcohol is preferably 70 mol % or more in the alcohol component, more preferably 90 mol % or more, even more preferably 95 mol % or more, and is 100 mol % or less, further more preferably 100 mol %.

Among these, an alkylene oxide adduct of an aromatic diol is preferred.

The alkylene oxide adduct of an aromatic diol is preferably an alkylene oxide adduct of bisphenol A, more preferably an alkylene oxide adduct of bisphenol A represented by the following formula (I).

(I)

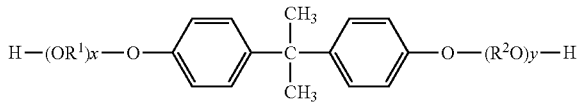

wherein $OR^1$ and $R^2O$ each represent an oxyalkylene group, $R^1$ and $R^2$ each independently represent an ethylene group or a propylene group, x and y each represents an average molar number of addition of an alkylene oxide, and each are a positive number, a sum of x and y is 1 or more, preferably 1.5 or more, and is 16 or less, preferably 8 or less, more preferably 4 or less.

Examples of the alkylene oxide adduct of bisphenol A include an propylene oxide adduct of bisphenol A [2,2-bis(4-hydroxyphenyl)propane], and an ethylene oxide adduct of bisphenol A. One alone or two or more of these may be used. Among these, a propylene oxide adduct of bisphenol A is preferred.

The content of the alkylene oxide adduct of bisphenol A is, in the alcohol component, preferably 70 mol % or more, more preferably 90 mol % or more, even more preferably 95 mol % or more, and is 100 mol % or less, further more preferably 100 mol %.

The alcohol component may contain, for example, a linear or branched aliphatic alcohol, an alicyclic alcohol and a trihydric or higher polyalcohol, in addition to the aromatic alcohol.

Examples of the linear or branched aliphatic diol include ethylene glycol, 1,2-propanediol, 1,3-propanediol, 1,2-butanediol, 1,3-butanediol, 1,4-butanediol, 2,3-butanediol, 2,2-dimethyl-1,3-propanediol, 1,6-hexanediol, 1,8-octanediol, 1,9-nonanediol, 1,10-decanediol, and 1,12-dodecanediol.

Examples of the alicyclic diol include hydrogenated bisphenol A [2,2-bis(4-hydroxycyclohexyl)propane], and an adduct of an alkylene oxide with 2 or more and 4 or less carbon atoms (having an average molar number of addition of 2 or more and 12 or less) of hydrogenated bisphenol A.

Examples of the trihydric or higher polyalcohol include glycerin, pentaerythritol, trimethylolpropane and sorbitol.

One alone or two or more kinds of these alcohol components may be used.

Examples of the carboxylic acid component include a dicarboxylic acid and a tribasic or higher polycarboxylic acid.

Examples of the dicarboxylic acid include an aromatic dicarboxylic acid, a linear or branched aliphatic dicarboxylic acid, and an alicyclic dicarboxylic acid. Among these, at least one selected from an aromatic dicarboxylic acid and a linear or branched dicarboxylic acid is preferred.

Examples of the aromatic dicarboxylic acid include phthalic acid, isophthalic acid, and terephthalic acid. Among these, isophthalic acid and terephthalic acid are preferred, and terephthalic acid is more preferred.

The amount of the aromatic dicarboxylic acid is, in the carboxylic acid component, preferably 20 mol % or more, more preferably 30 mol % or more, even more preferably 40 mol % or more, and is preferably 90 mol % or less, more preferably 80 mol % or less, even more preferably 75 mol % or less.

The carbon number of the linear or branched aliphatic dicarboxylic acid is preferably 2 or more, more preferably 3 or more, and is preferably 30 or less, more preferably 20 or less.

Examples of the linear or branched aliphatic dicarboxylic acid include oxalic acid, malonic acid, maleic acid, fumaric acid, citraconic acid, itaconic acid, glutaconic acid, succinic acid, adipic acid, sebacic acid, dodecanedioic acid, azelaic acid, and succinic acid substituted with an alkyl group having 1 or more and 20 or less carbon atoms or an alkenyl group having 2 or more and 20 or less carbon atoms. Examples of the succinic acid substituted with an alkyl group having 1 or more and 20 or less carbon atoms or an alkenyl group having 2 or more and 20 or less carbon atoms include dodecylsuccinic acid, dodecenylsuccinic acid and octenylsuccinic acid. Among these, fumaric acid and sebacic acid are preferred.

The amount of the linear or branched aliphatic dicarboxylic acid is, in the carboxylic acid component, preferably 1 mol % or more, more preferably 10 mol % or more, and is preferably 50 mol % or less, more preferably 30 mol % or less.

The tribasic or higher polycarboxylic acid is preferably a tribasic carboxylic acid, and examples thereof include trimellitic acid or an anhydride thereof.

In the case of containing a tribasic or higher polycarboxylic acid, the amount of the tribasic or higher polycarboxylic acid is, in the carboxylic acid component, preferably 3 mol % or more, more preferably 5 mol % or more, even more preferably 8 mol % or more, and is preferably 30 mol % or less, more preferably 20 mol % or less, even more preferably 15 mol % or less.

One alone or two or more kinds of these carboxylic acid components may be used.

The equivalent ratio of the carboxy group in the carboxylic acid component to the hydroxy group in the alcohol component [COOH group/OH group] is preferably 0.7 or more, more preferably 0.8 or more, and is preferably 1.3 or less, more preferably 1.2 or less.

In the case where the resin A is a composite resin, the polyester resin segment therein is preferably the above-mentioned polyester resin, from the viewpoint of obtaining a toner capable of providing a high image density at a high yield.

In the case where the resin A is a composite resin, the addition polymer resin segment therein is preferably an addition polymer of a raw material monomer containing a styrenic compound s, from the viewpoint of realizing a more excellent image density.

The styrenic compound s includes a substituted or unsubstituted styrene.

Examples of the substituent for the substituted styrene include an alkyl group having 1 or more and 5 or less carbon atoms, a halogen atom, an alkoxy group having 1 or more and 5 or less carbon atoms, and a sulfo group or a salt thereof.

Examples of the styrenic compound s include styrene, methylstyrene, α-methylstyrene, β-methylstyrene, tert-butylstyrene, chlorostyrene, chloromethylstyrene, methoxystyrene, and styrenesulfonic acid or a salt thereof. Among these, styrene is preferred.

In the raw material monomer for the addition polymer resin segment, the content of the styrenic compound s is preferably 50% by mass or more, more preferably 65% by mass or more, even more preferably 70% by mass or more, and is 100% by mass or less, preferably 95% by mass or less, more preferably 90% by mass or less, even more preferably 85% by mass or less.

Examples of the other raw material monomer than the styrenic compound s include (meth)acrylates such as alkyl (meth)acrylates, benzyl (meth)acrylate, and dimethylaminoethyl (meth)acrylate; olefins such as ethylene, propylene and butadiene; vinyl halides such as vinyl chloride; vinyl esters such as vinyl acetate and vinyl propionate; vinyl ethers such as vinyl methyl ether; vinylidene halides such as vinylidene chloride; N-vinyl compounds such as N-vinylpyrrolidone. Among these, (meth)acrylates are preferred, and alkyl (meth)acrylates are more preferred.

The carbon number of the alkyl group in the alkyl (meth)acrylate is, from the viewpoint of attaining more excellent image density, preferably 1 or more, more preferably 4 or more, even more preferably 6 or more, further more preferably 10 or more, further more preferably 14 or more, further more preferably 16 or more, and is preferably 24 or less, more preferably 22 or less, even more preferably 20 or less.

Examples of the alkyl (meth)acrylate include methyl (meth)acrylate, ethyl (meth)acrylate, (iso)propyl (meth) acrylate, (iso or tertiary)butyl (meth)acrylate, (iso)amyl (meth)acrylate, cyclohexyl (meth)acrylate, 2-ethylhexyl (meth)acrylate, (iso)octyl (meth)acrylate, (iso)decyl (meth) acrylate, (iso)dodecyl (meth)acrylate, (iso)palmityl (meth) acrylate, (iso)stearyl (meth)acrylate, and (iso)behenyl (meth)acrylate. Among these, butyl (meth)acrylate, 2-ethylhexyl (meth)acrylate, dodecyl (meth)acrylate and stearyl (meth)acrylate are preferred, 2-ethylhexyl (meth)acrylate, dodecyl (meth)acrylate and stearyl (meth)acrylate are more preferred, dodecyl (meth)acrylate and stearyl (meth)acrylate are even more preferred, and stearyl methacrylate is further more preferred.

In the raw material monomer for the addition polymer resin segment, the content of the (meth)acrylate is preferably 5% by mass or more, more preferably 10% by mass or more, even more preferably 15% by mass or more, and is preferably 50% by mass or less, more preferably 40% by mass or less, even more preferably 30% by mass or less.

The total amount of the styrenic compound s and the (meth)acrylate in the raw material monomer for the addition polymer resin segment is preferably 80% by mass or more, more preferably 90% by mass or more, even more preferably 95% by mass or more, further more preferably 100% by mass.

In the case where the resin A is a composite resin, preferably, the composite resin has a structural unit derived from a bireactive monomer bonding to the polyester resin segment and the addition polymer resin segment therein via a covalent bond.

"Structural unit derived from a bireactive monomer" means a unit formed through reaction of the functional group and the unsaturated bond site of a bireactive monomer.

Examples of the bireactive monomer include an addition-polymerizing monomer having at least one functional group selected from a hydroxy group, a carboxy group, an epoxy group, a primary amino group and a secondary amino group in the molecule. Among these, from the viewpoint of reactivity, an addition-polymerizing monomer having at least one functional group selected from a hydroxy group and a carboxy group is preferred, and an addition-polymerizing monomer having a carboxy group is more preferred.

Examples of the addition-polymerizing monomer having a carboxy group include acrylic acid, methacrylic acid, fumaric acid and maleic acid. Among these, from the viewpoint of reactivity in both polycondensation reaction and addition polymerization reaction, acrylic acid and methacrylic acid are preferred, and acrylic acid is more preferred.

The amount of the structural unit derived from a bireactive monomer is, relative to 100 parts by mol of the alcohol component of the polyester resin segment of the composite resin, preferably 1 part by mol or more, more preferably 5 parts by mol or more, even more preferably 8 parts by mol or more, and is preferably 30 parts by mol or less, more preferably 25 parts by mol or less, even more preferably 20 parts by mol or less.

The resin A may have a structural unit derived from a hydrocarbon wax W1.

Examples of the structural unit derived from a hydrocarbon wax W1 include a hydrocarbon wax W1 where a hydroxy group or a carboxy group reacts and bonds to a polyester resin segment via a covalent bond.

The hydrocarbon wax W1 has at least any of a carboxy group and a hydroxy group. The hydrocarbon wax W1 may have any one or both of a hydroxy group and a carboxy group, but preferably has a hydroxy group and a carboxy group from the viewpoint of increasing the image density of prints.

The hydrocarbon wax W1 can be produced, for example, by modifying an unmodified hydrocarbon wax according to a known method. Examples of a raw material for the hydrocarbon wax W1 include paraffin wax, Fischer-Tropsch wax, microcrystalline wax, polyethylene wax, and polypropylene wax. Among these, paraffin wax and Fischer-Tropsch wax are preferred.

Examples of commercial products of hydrocarbon wax having a hydroxy group include "Unilin 700", "Unilin 425" and "Unilin 550" (all from Baker Petrolite Corporation).

Examples of hydrocarbon wax having a carboxy group include an acid-modified hydrocarbon wax.

Examples of commercial products of hydrocarbon wax having a carboxy group include a maleic anhydride-modified ethylene-propylene copolymer "HI-WAX 1105A" (from Mitsui Chemicals Inc.).

Examples of commercial products of hydrocarbon wax having a hydroxy group and a carboxy group include "Paracol 6420", "Paracol 6470" and "Paracol 6490" (all from Nippon Seiro Co., Ltd.).

The hydroxyl value of the hydrocarbon wax W1 is, from the viewpoint of increasing the image density of prints, preferably 35 mgKOH/g or more, more preferably 50 mgKOH/g or more, even more preferably 70 mgKOH/g or more, and is preferably 180 mgKOH/g or less, more preferably 150 mgKOH/g or less, even more preferably 120 mgKOH/g or less.

The acid value of the hydrocarbon wax W1 is, from the viewpoint of increasing the image density of prints, preferably 1 mgKOH/g or more, more preferably 5 mgKOH/g or more, even more preferably 10 mgKOH/g or more, and is preferably 30 mgKOH/g or less, more preferably 25 mgKOH/g or less, even more preferably 20 mgKOH/g or less.

The total of the hydroxyl value and the acid value of the hydrocarbon wax W1 is, from the viewpoint of increasing the image density of prints, preferably 35 mgKOH/g or more, more preferably 40 mgKOH/g or more, even more preferably 60 mgKOH/g or more, further more preferably 80 mgKOH/g or more, further more preferably 90 mgKOH/g or more, and is preferably 210 mgKOH/g or less, more preferably 175 mgKOH/g or less, even more preferably 140 mgKOH/g or less, further more preferably 120 mgKOH/g or less.

The number-average molecular weight of the hydrocarbon wax W1 is, from the viewpoint of increasing the image density of prints, preferably 500 or more, more preferably 600 or more, even more preferably 700 or more, and is preferably 2,000 or less, more preferably 1,700 or less, even more preferably 1,500 or less.

The hydroxyl value and the acid value of the hydrocarbon wax W1 are measured according to the method described in the section of Examples. The number-average molecular weight of the hydrocarbon wax W1 is measured through gel permeation chromatography using chloroform as a solvent and using polystyrene as a standard substance.

In the case where the resin A is a composite resin, a preferred range of the content of each component therein is as follows.

The content of the polyester resin segment in the composite resin is, relative to the total amount of the polyester resin segment, the addition polymer resin segment and the bireactive monomer-derived structural unit therein, preferably 40% by mass or more, more preferably 45% by mass or more, even more preferably 55% by mass or more, and is preferably 90% by mass or less, more preferably 85% by mass or less, even more preferably 75% by mass or less.

The content of the addition polymer resin segment in the composite resin is, relative to the total amount of the polyester resin segment, the addition polymer resin segment and the bireactive monomer-derived structural unit therein, preferably 10% by mass or more, more preferably 15% by mass or more, even more preferably 25% by mass or more, and is preferably 60% by mass or less, more preferably 55% by mass or less, even more preferably 45% by mass or less.

The amount of the structural unit derived from a bireactive monomer in the composite resin is, relative to the total amount of the polyester resin segment, the addition polymer resin segment and the bireactive monomer-derived structural unit therein, preferably 0.1% by mass or more, more preferably 0.5% by mass or more, even more preferably 0.8% by mass or more, and is preferably 10% by mass or less, more preferably 5% by mass or less, even more preferably 3% by mass or less.

The amount of the structural unit derived from the hydrocarbon wax W1 in the composite resin is, relative to the total amount, 100 parts by mass, of the polyester resin segment, the addition polymer resin segment and the bireactive monomer-derived structural unit therein, preferably 0.1 part by mass or more, more preferably 0.5 part by mass or more, even more preferably 1 part by mass or more, and is preferably 10 parts by mass or less, more preferably 8 parts by mass or less, even more preferably 6 parts by mass or less.

The total amount of the polyester resin segment, the addition polymer resin segment, the bireactive monomer-derived structural unit and the hydrocarbon wax W1-derived structural unit in the composite resin is preferably 80% by mass or more, more preferably 90% by mass or more, even more preferably 95% by mass or more, and is 100% by mass or less, more preferably 100% by mass.

The above-mentioned amount is calculated based on the quantitative ratio of the raw material monomers for the polyester resin segment and the addition polymer resin segment, the bireactive monomer, the hydrocarbon wax W1-derived structural unit and the radical polymerization initiator used, and the dehydration amount in polycondensation for the polyester resin segment and others is excluded. In the case where a radical polymerization initiator is used, the mass of the radical polymerization initiator is included and calculated in the addition polymer resin segment.

The resin A may be produced, for example, according to a method that includes a step A of polycondensation of an alcohol component and a carboxylic acid component.

In the case where the resin A has a structural unit derived from a hydrocarbon wax W1, for example, an alcohol component and a carboxylic acid component are polycondensed in the presence of a hydrocarbon wax W1 having at least any of a hydroxy group and a carboxy group in the step A.

In the step A, as needed, polycondensation may be carried out in the presence of an esterification catalyst such as tin(II) di(2-ethylhexanoate), dibutyltin oxide, or titanium diisopropylate bistriethanolaminate in an amount of 0.01 part by mass or more and 5 parts by mass or less relative to the total amount, 100 parts by mass of the alcohol component and the carboxylic acid component, along with an esterification promoter such as gallic acid (same as 3,4,5-trihydroxybenzoic acid) in an amount of 0.001 part by mass or more and 0.5 part by mass or less relative to the total amount, 100 parts by mass of the alcohol component and the carboxylic acid component.

In the case where a monomer having an unsaturated bond such as fumaric acid is used in polycondensation reaction, as needed, a radical polymerization inhibitor may be used preferably in an amount of 0.001 part by mass or more and 0.5 part by mass or less relative to the total amount, 100 parts by mass of the alcohol component and the carboxylic acid component. Examples of the radical polymerization inhibitor include 4-tert-butylcatechol.

The polycondensation reaction temperature is preferably 120° C. or higher, more preferably 160° C. or higher, even more preferably 180° C. or higher, and is preferably 250° C. or lower, more preferably 230° C. or lower. Polycondensation may be carried out in an inert gas atmosphere.

In the case where the resin A is a composite resin, the composite resin may be produced, for example, according to a method that includes a step A of polycondensation of an alcohol component and a carboxylic acid component, and a step B of addition polymerization with a raw material monomer for the addition polymer resin segment and a bireactive monomer.

The step B may be carried out after the step A, or the step A may be carried out after the step B, or the step A and the step B may be carried out simultaneously.

In the step A, more preferably, a part of a carboxylic acid component is subjected to polycondensation reaction, then the step B is carried out, and thereafter the remaining part of the carboxylic acid component is added to the polymerization step, and the polycondensation reaction in the step A and optionally reaction with a bireactive monomer are further carried out.

Examples of the polymerization initiator for addition polymerization include peroxides such as dibutyl peroxide; persulfates such as sodium persulfate; and azo compounds such as 2,2'-azobis(2,4-dimethylvaleronitrile).

The amount of the polymerization initiator to be used is preferably 1 part by mass or more and 20 parts by mass or less relative to 100 parts by mass of the raw material monomer for the addition polymer resin segment.

The addition polymerization reaction temperature is preferably 110° C. or higher, more preferably 130° C. or higher, and is preferably 220° C. or lower, more preferably 200° C. or lower, even more preferably 180° C. or lower.

(Properties of Resin A)

The softening point of the resin A is preferably 70° C. or higher, more preferably 90° C. or higher, even more preferably 100° C. or higher, and is preferably 140° C. or lower, more preferably 130° C. or lower, even more preferably 125° C. or lower.

The glass transition temperature of the resin A is preferably 30° C. or higher, more preferably 40° C. or higher, even more preferably 50° C. or higher, and is preferably 80° C. or lower, more preferably 70° C. or lower, even more preferably 60° C. or lower.

The acid value of the resin A is preferably 5 mgKOH/g or more, more preferably 10 mgKOH/g or more, even more preferably 15 mgKOH/g or more, and is preferably 40 mgKOH/g or less, more preferably 35 mgKOH/g or less, even more preferably 30 mgKOH/g or less.

The softening point, the glass transition temperature and the acid value of the resin A can be appropriately controlled, depending on the kind and the amount of the raw material monomer used, and on the production conditions such as the reaction temperature, the reaction time and the cooling speed, and the values can be determined according to the methods described in the section of Examples.

In the case where two or more kinds of the resin A are used as combined, preferably, the softening point, the glass transition temperature and the acid value of the mixture each fall within the above-mentioned range.

(Resin B)

The resin B is a crystalline polyester resin from the viewpoint of obtaining a toner capable of providing a high image density at a high yield.

For example, the resin B is a polycondensate of an alcohol component and a carboxylic acid component.

Preferably, the alcohol component contains an α,ω-aliphatic diol.

The carbon number of the α,ω-aliphatic diol is preferably 2 or more, more preferably 4 or more, even more preferably 6 or more, and is preferably 16 or less, more preferably 14 or less, even more preferably 12 or less.

Examples of the α,ω-aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, and 1,14-tetradecanediol. Among these, 1,4-butanediol or 1,10-decanediol is preferred.

The amount of the α,ω-aliphatic diol in the alcohol component is preferably 80 mol % or more, more preferably 85 mol % or more, even more preferably 90 mol % or more, further more preferably 95 mol % or more, and is 100 mol % or less, further more preferably 100 mol %.

The alcohol component may contain any other alcohol component than the α,ω-aliphatic diol. Examples of the other alcohol component include other aliphatic diols than α,ω-aliphatic diols, such as 1,2-propylene glycol, and neopentyl glycol; aromatic diols such as an alkylene oxide adduct of bisphenol A; and trihydric or higher alcohols such as glycerin, pentaerythritol, and trimethylolpropane. One alone or two or more kinds of these alcohol components may be used.

Preferably, the carboxylic acid contains an aliphatic dicarboxylic acid.

The carbon number of the aliphatic dicarboxylic acid is preferably 4 or more, more preferably 8 or more, even more preferably 10 or more, and is preferably 14 or less, more preferably 12 or less.

Examples of the aliphatic dicarboxylic acid include fumaric acid, sebacic acid, dodecanedioic acid, and tetradecanedioic acid. Among these, sebacic acid, dodecanedioic acid or tetradecanedioic acid is preferred, and sebacic acid is more preferred. One alone or two or more kinds of these carboxylic acid components may be used.

The amount of the aliphatic dicarboxylic acid in the carboxylic acid component is preferably 80 mol % or more, more preferably 85 mol % or more, even more preferably 90 mol % or more, further more preferably 95 mol % or more, and is 100 mol % or less, further more preferably 100 mol %.

The carboxylic acid component may contain any other carboxylic acid component than aliphatic dicarboxylic acids. Examples of the other carboxylic acid component include an aromatic dicarboxylic acid such as terephthalic acid and isophthalic acid; and a tribasic or higher polycarboxylic acid. One alone or two or more kinds of these carboxylic acid components may be used.

The equivalent ratio of the carboxy group in the carboxylic acid component to the hydroxy group in the alcohol component [COOH group/OH group] is preferably 0.7 or more, more preferably 0.8 or more, and is preferably 1.3 or less, more preferably 1.2 or less.

(Properties of Resin B)

The softening point of the resin B is preferably 60° C. or higher, more preferably 70° C. or higher, even more preferably 80° C. or higher, and is preferably 150° C. or lower, more preferably 120° C. or lower, even more preferably 100° C. or lower.

The melting point of the resin B is preferably 50° C. or higher, more preferably 60° C. or higher, even more preferably 70° C. or higher, and is preferably 100° C. or lower, more preferably 95° C. or lower.

The acid value of the resin B is preferably 5 mgKOH/g or more, more preferably 10 mgKOH/g or more, and is preferably 35 mgKOH/g or less, more preferably 30 mgKOH/g or less, even more preferably 25 mgKOH/g or less.

The softening point, the melting point and the acid value of the resin B can be appropriately controlled, depending on the kind and the ratio of the raw material monomer used, and on the production conditions such as the reaction temperature, the reaction time and the cooling speed. These values can be determined according to the methods described in the section of Examples given hereunder. In the case where two or more kinds of the resin B are used as combined, preferably, the softening point, the melting point and the acid value of the mixture each fall within the above-mentioned range.

The resin B can be produced, for example, through polycondensation of an alcohol component and a carboxylic acid component. For the conditions for the polycondensation, those for polycondensation to give the resin A as above can be employed.

The ratio by mass of the resin B to the resin A [B/A] is preferably 1/99 or more, more preferably 5/95 or more, even more preferably 10/90 or more, further more preferably 20/80 or more, and is preferably 50/50 or less, more preferably 40/60 or less, even more preferably 35/65 or less.

In the resin component of the toner, the content of the resin A and the resin B is preferably 80% by mass or more, more preferably 90% by mass or more, even more preferably 95% by mass or more, and is 100% by mass or less, preferably 100% by mass.

[Resin Particles X]

The resin particles X contain the resin A from the viewpoint of improving image density.

[Production Method for Resin Particles X]

A dispersion of the resin particles X can be prepared by dispersing the resin A in an aqueous medium.

The aqueous medium is preferably one containing water as a main component, and from the viewpoint of improving the dispersion stability of the dispersion of resin particles and from the viewpoint of environmental performance, the content of water in the aqueous medium is preferably 80% by mass or more, more preferably 90% by mass or more, even more preferably 95% by mass or more, and is 100% by mass or less, more preferably 100% by mass. As water, deionized water or distilled water is preferred. Examples of the other component than water that may be contained in the aqueous medium include an organic solvent capable of dissolving in water, for example, an alkyl alcohol having 1 or more and 5 or less carbon atoms; a dialkyl ketone having a total carbon number of 3 or more and 5 or less, such as acetone or methyl ethyl ketone; and a cyclic ether such as tetrahydrofuran. Among these, methyl ethyl ketone is preferred.

Dispersion can be carried out according to a known method, but dispersion according to a phase-transfer emulsification method is preferred. Examples of the phase-transfer emulsification method include a method of phase-transfer emulsification by addition of an aqueous medium to an organic solvent solution of a resin or a melted resin.

The organic solvent for use for phase-transfer emulsification is not specifically limited so far as it can dissolve resin, and examples thereof include methyl ethyl ketone.

To the organic solvent solution, preferably a neutralizing agent is added. Examples of the neutralizing agent include a basic substance. Examples of the basic substance include an alkali metal hydroxide such as sodium hydroxide and potassium hydroxide; and a nitrogen-containing basic substance such as ammonia, trimethylamine, and diethanolamine.

The degree of neutralization of the resin contained in the resin particles X is preferably 10 mol % or more, more preferably 20 mol % or more, even more preferably 30 mol % or more, further more preferably 40 mol % or more, and is preferably 100 mol % or less, more preferably 80 mol % or less, even more preferably 70 mol % or less.

The degree of neutralization of the resin contained in the resin particles can be determined according to the following expression.

Degree of neutralization (mol %)=[{mass of neutralizing agent added (g)/equivalent of neutralizing agent}/[{weighted average acid value of resin constituting resin particles $X$(mgKOH/g)×mass of resin constituting resin particles $X$(g)}/(56×1,000)]]×100

With stirring the organic solvent solution or the melted resin, an aqueous medium is gradually added thereto for phase transfer.

The organic solvent solution temperature at the time when an aqueous medium is added thereto is, from the viewpoint of improving the dispersion stability of the resin particles X, preferably not lower than the glass transition temperature of the resin constituting the resin particles X, more preferably 50° C. or higher, even more preferably 60° C. or higher, further more preferably 70° C. or higher, and is preferably 100° C. or lower, more preferably 90° C. or lower, even more preferably 80° C. or lower.

After phase-transfer emulsification, as needed, the organic solvent may be removed from the resultant dispersion by distillation or the like. In this case, the remaining amount of the organic solvent in the dispersion is preferably 1% by mass or less, more preferably 0.5% by mass or less, even more preferably substantially 0% by mass.

The volume median particle diameter ($D_{50}$) of the resin particles X in the dispersion is, from the viewpoint of obtaining a toner capable of providing a high-quality image, preferably 0.05 μm or more, more preferably 0.08 μm or more, and is preferably 1 μm or less, more preferably 0.5 μm or less, even more preferably 0.3 μm or less.

The CV value of the resin particles X in the dispersion is, from the viewpoint of obtaining a toner capable of providing a high-quality image, preferably 10% or more, more preferably 20% or more, and is preferably 40% or less, more preferably 30% or less.

The volume median particle diameter $D_{50}$ and the CV value are determined according to the methods described in the section of Examples given hereinunder.

The resin particles Y containing the resin B, and the resin particles XY containing the resin A and the resin B all can be produced according to the above-mentioned method. Preferred ranges of the volume medium particle diameter $D_{50}$ and the CV value of the resin particles Y and the resin particles XY are the same as those mentioned hereinabove.

[Colorant Particles Z]

The colorant particles Z contain a colorant and an addition polymer E, from the viewpoint of obtaining a toner that secures high image density at a high yield. The colorant particles Z have, for example, an addition polymer E on the surface of a colorant preferably in such a manner that the surface of a colorant is coated with an addition polymer E.

(Colorant)

As the colorant, all kinds of dye and pigment that are used as a colorant for toner are usable, and examples thereof include carbon black, phthalocyanine blue, permanent brown FG, brilliant fast scarlet, pigment green B, rhodamine-B base, sorbent red 49, sorbent red 146, sorbent blue 35, quinacridone, carmine 6B, monoazo yellow, disazo yellow, and isoindoline yellow. The toner may be any of a black toner and any other color toner than black.

Among these, carbon black is preferred.

Examples of carbon black include furnace black, thermal lamp black, acetylene black, and channel black. Among these, furnace black is preferred from the viewpoint of coloring power and charge control.

The pH value of carbon black is, from the viewpoint of more increasing the image density, preferably 5 or more, more preferably 6 or more, even more preferably 6.5 or more, and is preferably 9 or less, more preferably 8 or less, even more preferably 7.5 or less.

Specifically, the pH value of carbon black can be measured according to the following process.

(1) 5 g of carbon black and 50 mL of distilled water having pH of 7 are put into a container and mixed therein.

(2) This is boiled for 15 minutes, and then cooled to room temperature taking 30 minutes.

(3) The electrode of a pH meter is immersed in the supernatant and the pH is measured.

The pH meter is, for example, "HM30R" (from DKK-TOA Corporation).

The dibutyl phthalate (DBP) oil absorption amount of carbon black is, from the viewpoint of the charge amount distribution of toner, preferably 20 ml/100 g or more, more preferably 30 ml/100 g or more, even more preferably 35 ml/100 g or more, and is preferably 90 ml/100 g or less, more preferably 75 ml/100 g or less, even more preferably 50 ml/100 g or less.

The DBP oil absorption amount of carbon black can be measured according to "How to Determine Oil Absorption Amount" in ISO4656 (JIS K 6217-4:2008).

The BET specific surface area of carbon black is, from the viewpoint of coloring power, preferably 50 $m^2/g$ or more, more preferably 60 $m^2/g$ or more, even more preferably 90 $m^2/g$ or more, further more preferably 100 $m^2/g$ or more.

Also from the viewpoint of charge amount distribution, it is preferably 150 $m^2/g$ or less, more preferably 130 $m^2/g$ or less, even more preferably 115 $m^2/g$ or less.

The BET specific surface area of carbon black is measured according to JIS K 6217-2:2017.

(Addition Polymer E)

The addition polymer E is an addition polymer of a raw material monomer containing an addition-polymerizing monomer a having an aromatic group (hereinafter may be simply referred to as "monomer a"), from the viewpoint of obtaining a toner capable of providing a high image density at a high yield. Also from the viewpoint of obtaining a toner capable of providing a higher image density at a higher yield, the addition polymer E contains a structural unit derived from an aromatic group-having addition-polymerizing monomer a in the main chain thereof.

Preferably, the raw material monomer for the addition polymer E contains an ionic group-having addition-polymerizing monomer b (hereinafter may be simply referred to as "monomer b") in addition to the aromatic group-having addition-polymerizing monomer a.

More preferably, the raw material monomer for the addition polymer E further contains at least one selected from a polyalkylene oxide group-having addition-polymerizing monomer c (hereinafter may be simply referred to as "monomer c") or macromonomer d (hereinafter may be simply referred to as "monomer d"), in addition to the monomer b.

The addition polymer E is, from the viewpoint of increasing image density, preferably a water-insoluble addition polymer.

Here, "water-insoluble" means that, when a sample dried at 105° C. for 2 hours is dissolved in 100 g of ion-exchanged water at 25° C. until saturation, the amount of dissolution thereof is less than 10 g. The amount of dissolution is measured in a state where the ionic group of the addition polymer E is 100% neutralized. For example, in the case of an addition polymer having a carboxy group, the amount of dissolution thereof is one measured in a state where the carboxy group of the addition polymer is 100% neutralized with sodium hydroxide.

The amount of dissolution of the addition polymer E in water is preferably 5 g or less, more preferably 1 g or less.

The molecular weight of the aromatic group-having addition-polymerizing monomer a is preferably less than 1,000, more preferably 800 or less, even more preferably 500 or less, further more preferably 300 or less, and is preferably 80 or more, more preferably 90 or more, even more preferably 100 or more.

The aromatic group-having addition-polymerizing monomer a is preferably non-ionic.

Examples of the aromatic group-having addition-polymerizing monomer a include a styrenic compound a-1, and an aromatic group-containing (meth)acrylate a-2.

Examples of the styrenic compound a-1 include a substituted or unsubstituted styrene. Examples of the substituent for the substituted styrene include an alkyl group having 1 or more and 5 or less carbon atoms, a halogen atom, an alkoxy group having 1 or more and 5 or less carbon atoms, and a sulfo group or a salt thereof.

The molecular weight of the styrenic compound a-1 is preferably less than 1,000, more preferably 800 or less, even more preferably 500 or less, further more preferably 300 or less, and is preferably 80 or more, more preferably 90 or more, even more preferably 100 or more.

Examples of the styrenic compound a-1 include styrene, methylstyrene, α-methylstyrene, β-methylstyrene, tert-butylstyrene, chlorostyrene, chloromethylstyrene, methoxystyrene, and styrenesulfonic acid or a salt thereof. Among these, styrene is preferred.

The amount of the styrenic compound a-1 is, from the viewpoint of more improving image density, preferably 1% by mass or more in the raw material monomer for the addition polymer E, more preferably 5% by mass or more, even more preferably 10% by mass or more, further more preferably 20% by mass or more, further more preferably 30% by mass or more, further more preferably 35% by mass or more, and is preferably 98% by mass or less, more preferably 80% by mass or less, even more preferably 65% by mass or less, further more preferably 50% by mass or less.

Examples of the aromatic group-containing (meth)acrylate a-2 include benzyl (meth)acrylate.

The amount of the aromatic group-containing (meth) acrylate a-2 is, from the viewpoint of more improving image density, preferably 1% by mass or more in the raw material monomer for the addition polymer E, more preferably 5% by mass or more, even more preferably 10% by mass or more, and is preferably 50% by mass or less, more preferably 40% by mass or less, even more preferably 30% by mass or less.

The amount of the aromatic group-having addition-polymerizing monomer a is, from the viewpoint of more improving image density, preferably 1% by mass or more in the raw material monomer for the addition polymer E, more preferably 5% by mass or more, even more preferably 10% by mass or more, further more preferably 20% by mass or more, further more preferably 30% by mass or more, further more preferably 35% by mass or more, and is preferably 98% by mass or less, more preferably 95% by mass or less, even more preferably 90% by mass or less, further more preferably 80% by mass or less, further more preferably 65% by mass or less, further more preferably 50% by mass or less.

The ionic group in the monomer b means a group that ionically dissociates in water.

Examples of the ionic group include a carboxy group, a sulfo group, a phosphoric acid group, an amino group, or a salt thereof.

The ionic group is, from the viewpoint of improving dispersion stability of colorant particles, preferably an anionic group. The anionic group is preferably an acid group or a salt thereof, more preferably a carboxy group, a sulfo group, or a salt thereof, even more preferably a carboxy group or a salt thereof.

Examples of the addition-polymerizing monomer having a carboxy group include (meth)acrylic acid, itaconic acid, maleic acid, fumaric acid, and 2-methacryloyloxymethylsuccinic acid.

Among these, an anionic group-having addition-polymerizing monomer is preferred, (meth)acrylic acid is more preferred, and methacrylic acid is even more preferred.

In the case of containing the monomer b, the amount of the monomer b is preferably 2% by mass or more in the raw material monomer for the addition polymer E, more preferably 5% by mass or more, even more preferably 8% by mass or more, and is preferably 40% by mass or less, more preferably 30% by mass or less, even more preferably 25% by mass or less.

The average molar number of addition of the alkylene oxide in the polyalkylene oxide group in the monomer c is preferably 1 or more, more preferably 2 or more, even more preferably 3 or more, and is preferably 30 or less, more preferably 20 or less, even more preferably 10 or less.

The monomer c is preferably non-ionic.

Examples of the monomer c include a polyalkylene glycol (meth)acrylate such as polyethylene glycol (meth)acrylate, and polypropylene glycol (meth)acrylate; an alkoxypolyalkylene glycol (meth)acrylate such as methoxypolyethylene glycol (meth)acrylate; and an aryloxypolyalkylene glycol (meth)acrylate such as phenoxy(ethylene glycol-propylene glycol copolymer) (meth)acrylate.

In the case of containing the monomer c, the amount of the monomer c is preferably 3% by mass or more in the raw material monomer for the addition polymer E, more preferably 10% by mass or more, even more preferably 20% by mass or more, and is preferably 50% by mass or less, more preferably 40% by mass or less, even more preferably 30% by mass or less.

Examples of the monomer d include a styrenic compound polymer having an addition-polymerizing functional group at one terminal (hereinafter may be referred to as "styrenic macromonomer"). Examples of the addition-polymerizing functional group include a vinyl group, an allyl group, and a (meth)acryloyl group. Among these, a (meth)acryloyl group is preferred.

For the monomer d, the styrenic compound is preferably styrene.

The number-average molecular weight of the monomer d is preferably 1,000 or more and 10,000 or less. The number-average molecular weight is measured through gel permeation chromatography using chloroform that contains 1 mmol/L of dodecyldimethylamine as a solvent and using polystyrene as a standard substance.

Examples of commercial products of the styrenic macromonomer include "AS-6", "AS-6S", "AN-6", "AN-6S", "HS-6" and "HS-6S" (all from Toagosei Co., Ltd.).

In the case of containing the monomer d, the amount of the monomer d is preferably 3% by mass or more in the raw material monomer for the addition polymer E, more preferably 6% by mass or more, even more preferably 10% by mass or more, and is preferably 30% by mass or less, more preferably 25% by mass or less, even more preferably 20% by mass or less.

Further, the raw material monomer for the addition polymer E may contain any other addition-polymerizing monomer (other monomer) than the monomers a to d.

Examples of the other monomer include an alkyl (meth) acrylate having an alkyl group having 1 or more and 22 or less (preferably 6 or more and 18 or less) carbon atoms, and an aromatic group-containing (meth)acrylate. Examples of the aromatic group-containing (meth)acrylate include benzyl (meth)acrylate and phenoxyethyl (meth)acrylate.

In the case of containing some other monomer, the amount of the other monomer is preferably 40% by mass or less in the raw material monomer for the addition polymer E, more preferably 30% by mass or less, even more preferably 20% by mass or less, further more preferably 10% by mass or less, further more preferably 5% by mass or less.

The weight-average molecular weight of the addition polymer E is, from the viewpoint of more increasing image density, preferably 3,000 or more, more preferably 5,000 or more, even more preferably 20,000 or more, further more preferably 40,000 or more, further more preferably 48,000 or more, and is preferably 200,000 or less, more preferably 90,000 or less, even more preferably 60,000 or less, further more preferably 53,000 or less. The weight-average molecular weight can be measured according to the method described in the section of Examples.

The addition polymer E can be produced, for example, by copolymerizing a raw material monomer according to a known polymerization method. The polymerization method is, preferably, a solution polymerization method where a raw material monomer is polymerized under heat with a polymerization initiator and a polymerization chain transfer agent in a solvent.

Examples of the polymerization initiator include peroxides such as dibutyl peroxide; persulfates such as sodium persulfate; and azo compounds such as 2,2'-azobis(2,4-dimethylvaleronitrile).

The amount of the polymerization initiator to be added is, relative to 100 parts by mass of the raw material monomer, preferably 0.5 part by mass or more, and is preferably 30 parts by mass or less.

Examples of the polymerization chain transfer agent include mercaptans such as 2-mercaptoethanol and 3-mercaptopropionic acid.

The amount of the polymerization chain transfer agent to be added is, relative to 100 parts by mass of the raw material monomer, preferably 0.01 part by mass or more and is preferably 10 parts by mass or less.

After polymerization reaction, the formed polymer may be isolated and purified according to a known method such as reprecipitation and removal of the solvent from the reaction solution.

In the colorant particles, the ratio by mass of the colorant to the addition polymer E (colorant/addition polymer E) is, from the viewpoint of obtaining a toner giving a high image density at a high yield, 50/50 or more, preferably 60/40 or more, even more preferably 70/30 or more, further more preferably 75/25 or more, and is 95/5 or less, preferably 90/10 or less, more preferably 85/15 or less.

[Production Method for Colorant Particles Z]

Colorant particles Z can be produced, for example, by mixing a colorant and an addition polymer E.

A production method for a dispersion of colorant particles Z is not specifically limited, and using a known kneading machine or a dispersing machine, colorant particles are produced in a controlled manner so as to have a desired volume median particle diameter $D_{50}$. Preferably, a colorant and a dispersion of an addition polymer E are mixed using a bead mill or a homogenizer to give desired colorant particles.

The production method for colorant particles Z is preferably a method including:

Step a: a step of mixing an addition polymer E and an organic solvent, then optionally mixing with a neutralizing agent, and further mixing with an aqueous medium to give a dispersion of the addition polymer E, and Step b: a step of dispersing the dispersion prepared in the step a with a colorant to give a dispersion of colorant particles Z.

Since the step uses an organic solvent, the colorant and the addition polymer dissolve in the organic solvent and the addition polymer can be readily adsorbed by the colorant to further enhance the dispersibility of the colorant.

Preferably, in the step b, the dispersion prepared in the step a and a colorant are dispersed using a bead mill or a homogenizer.

In the step a, preferably, an addition polymer E and an organic solvent are first mixed.

Examples of the organic solvent to be used here include an alkyl alcohol having 1 or more and 3 or less carbon atoms, a dialkyl ketone having 3 or more and 5 or less carbon atoms in total, and a cyclic ether. Among these, a dialkyl ketone having 3 or more and 5 or less carbon atoms in total is preferred, and methyl ethyl ketone is more preferred. In the case where the addition polymer E is produced according to a solution polymerization method, the solvent used in the polymerization may be used as such also in this step.

Examples of the neutralizing agent include a basic substance. Examples of the basic substance include an alkali metal hydroxide such as sodium hydroxide and potassium hydroxide; and a nitrogen-containing basic substance such as ammonia, trimethylamine and diethanolamine.

The degree of neutralization of the addition polymer E is preferably 15 mol % or more, more preferably 20 mol % or more, even more preferably 40 mol % or more, further more preferably 60 mol % or more, further more preferably 80 mol % or more, and is preferably 100 mol % or less, more preferably 98 mol % or less, even more preferably 95 mol % or less.

The degree of neutralization of the addition polymer E can be determined according to the following expression.

Degree of neutralization (mol %)=[{mass of neutralizing agent added (g)/equivalent of neutralizing agent}/{ratio by mass of acid group-having addition-polymerizing monomer to constitute addition polymer *E*×mass of addition polymer *E*(g)/molecular weight of acid group-having addition-polymerizing monomer}]×100

In the step a, examples of the apparatus to be used for mixing include a mixing stirring device equipped with an anchor blade and a dispersal blade.

The temperature in mixing is preferably 0° C. or higher, more preferably 10° C. or higher, and is preferably 40° C. or lower, more preferably 30° C. or lower, even more preferably 25° C. or lower.

The mixing time is preferably 1 minute or more, more preferably 3 minutes or more, even more preferably 5 minutes or more, and is preferably 30 hours or less, more preferably 10 hours or less, even more preferably 5 hours or less, further more preferably 3 hours or less, further more preferably 1 hour or less.

In the step b, the ratio by mass of the colorant to the addition polymer E [colorant/addition polymer E] is as mentioned above.

Examples of the apparatus to be used in the step b include a kneading machine such as a roll mill and a kneader; a homogenizer such as a microfluidizer (from Microfluidic Corporation); and a medium-assisted dispersing machine such as a paint shaker and a bead mill. One alone or two or more kinds of these apparatuses may be used. Among these, use of a bead mill or a homogenizer is preferred from the viewpoint of forming pigment particles having a reduced particle size.

In the case of using a homogenizer, the treatment pressure is preferably 60 MPa or more, more preferably 100 MPa or more, even more preferably 130 MPa or more, and is preferably 270 MPa or less, more preferably 200 MPa or less, even more preferably 180 MPa or less.

The number of passes is preferably 5 or more, more preferably 10 or more, even more preferably 15 or more, and is preferably 30 or less, more preferably 25 or less.

Preferably, the organic solvent is removed from the resultant dispersion of colorant particles Z.

Also preferably, the dispersion of colorant particles Z is filtered through a wire cloth or the like to remove coarse particles. From the viewpoint of improving productivity and storage stability of the dispersion, the addition polymer E of the colorant particles may be crosslinked.

Various additives such as an organic solvent, an antiseptic agent, and a fungicide may be added to the dispersion of colorant particles Z.

The colorant in the dispersion of colorant particles Z is preferably 5% by mass or more, more preferably 10% by mass or more, and is preferably 50% by mass or less, more preferably 40% by mass or less, even more preferably 30% by mass or less, further more preferably 25% by mass or less.

The solid concentration in the dispersion of colorant particles Z is preferably 5% by mass or more, more preferably 10% by mass or more, even more preferably 15% by mass or more, and is preferably 50% by mass or less, more preferably 40% by mass or less, even more preferably 30% by mass or less.

The volume median particle diameter $D_{50}$ of the colorant particles Z is, from the viewpoint of increasing image density, preferably 0.05 μm or more, more preferably 0.08 μm or more, even more preferably 0.1 μm or more, and is preferably 0.4 μm or less, more preferably 0.3 μm or less, even more preferably 0.2 μm or less.

The CV value of the colorant particles Z is, from the viewpoint of increasing image density, preferably 10% or more, more preferably 20% or more, and is preferably 45% or less, more preferably 40% or less, even more preferably 35% or less.

The volume median particle diameter $D_{50}$ and the CV value of the colorant particles Z are measured according to the methods described in the section of Examples.

The amount of the colorant particles Z is, from the viewpoint of more improving image density, preferably 3 parts by mass or more, more preferably 6 parts by mass or more, even more preferably 10 parts by mass or more, and is preferably 40 parts by mass or less, more preferably 30 parts by mass or less, even more preferably 20 parts by mass or less, relative to 100 parts by mass of the resin particles.

[Wax]

The resin particles and the colorant particles Z can be aggregated in the presence of wax.

Examples of wax include hydrocarbon waxes or oxides thereof such as a polypropylene wax, a polyethylene wax, a polypropylene-polyethylene copolymer wax, a microcrystalline wax, a paraffin wax, a Fischer-Tropsch wax, and a Sasol wax; ester waxes such as a carnauba wax, a montan wax or deoxidized waxes thereof, and fatty acid ester waxes; fatty acid amides, fatty acids, higher alcohols, and fatty acid metal salts. One alone or two or more kinds thereof may be used.

Among these, hydrocarbon waxes and ester waxes are preferred, and hydrocarbon waxes are more preferred.

The melting point of the wax is preferably 60° C. or higher, more preferably 70° C. or higher, and is preferably 160° C. or lower, more preferably 150° C. or lower, even more preferably 140° C. or lower.

The amount of the wax is, in toner, preferably 0.1% by mass or more, more preferably 1% by mass or more, even more preferably 5% by mass or more, and is preferably 30% by mass or less, more preferably 25% by mass or less, even more preferably 20% by mass or less.

(Dispersion of Wax Particles)

Preferably, wax is, as a dispersion of wax particles, mixed and aggregated with resin particles and colorant particles Z.

The dispersion of wax particles can be prepared using a surfactant, but is preferably prepared by mixing wax with resin particles P to be mentioned hereinunder. By preparing wax particles by mixing wax and resin particles P, the wax particles can be stabilized by the resin particles P and therefore wax can be dispersed in an aqueous medium without using a surfactant. It is considered that, in the dispersion of wax particles, the resin particles P are so configured that a large number of them adhere to the surfaces of the wax particles.

The kind and the amount to be used of wax are the same as that of the above-mentioned wax.

The resin to constitute the resin particles P for dispersing wax is preferably a polyester-based resin, and from the viewpoint of improving dispersibility of wax in an aqueous medium, more preferably, a composite resin D having a polyester resin segment and an addition polymer resin segment is used.

The softening point of the composite resin D is preferably 70° C. or higher, more preferably 80° C. or higher, and is preferably 140° C. or lower, more preferably 120° C. or lower, even more preferably 100° C. or lower.

The preferred range of the other resin properties of the composite resin D, and preferred examples of the raw material monomer to constitute the resin are the same as those exemplified hereinabove for the composite resin A. The dispersion of the resin particles P can be prepared, for example, according to the above-mentioned phase-transfer emulsification method.

The volume median particle diameter $D_{50}$ of the resin particles P is, from the viewpoint of dispersion stability of wax particles, preferably 0.01 μm or more, more preferably 0.03 μm or more, and is preferably 0.3 μm or less, more preferably 0.2 μm or less.

The CV value of the resin particles P is, from the viewpoint of dispersion stability of wax particles, preferably 10% or more, more preferably 20% or more, and is preferably 40% or less, more preferably 35% or less, even more preferably 30% or less.

The wax particle dispersion can be prepared, for example, by dispersing a wax and a dispersion of resin particles P and optionally an aqueous medium, at a temperature not lower than the melting point of the wax, using a dispersing machine having a strong shear force such as a homogenizer, a high-pressure dispersing machine or an ultrasonic dispersing machine.

The heating temperature in dispersion is preferably a temperature not lower than the melting point of wax and 80° C. or higher, more preferably 85° C. or higher, even more preferably 90° C. or higher, and is preferably lower than a temperature higher by 10° C. than the softening point of the resin contained in the resin particles P and 100° C. or lower, more preferably 98° C. or lower, even more preferably 95° C. or lower.

The amount of the resin particles P is preferably 5 parts by mass or more, more preferably 10 parts by mass or more, even more preferably 20 parts by mass or more, and is preferably 90 parts by mass or less, more preferably 70 parts by mass or less, even more preferably 50 parts by mass or less, relative to 100 parts by mass of wax.

The volume median particle diameter $D_{50}$ of the wax particles is, from the viewpoint of obtaining uniform aggregate particles, preferably 0.05 μm or more, more preferably 0.2 μm or more, even more preferably 0.3 μm or more, and is preferably 1 μm or less, more preferably 0.8 μm or less, even more preferably 0.6 μm or less.

The CV value of the wax particles is preferably 10% or more, more preferably 20% or more, and is preferably 40% or less, more preferably 35% or less, even more preferably 30% or less.

The volume median particle diameter $D_{50}$ and the CV value of the wax particles are measured according to the methods described in the section of Examples.

The resin particle and the colorant particles Z can be aggregated in the presence of any other additive in addition to wax.

Examples of the other additive include a charge controlling agent, a magnetic powder, a fluidity enhancer, a conductivity controlling agent, a reinforcing filler such as a fibrous substance, an antioxidant, an anti-aging agent, and a cleaning property enhancer.

[Surfactant]

In the step 1, in mixing dispersions of particles to prepare a mixed dispersion, from the viewpoint of improving dispersion stability of the resin particles, the colorant particles Z and other optional components such as wax particles that are optionally added, the mixing operation can be carried out in the presence of a surfactant. Examples of the surfactant include anionic surfactants such as alkylbenzenesulfonate salts, and alkylether sulfonate salts; and nonionic surfactants such as polyoxyethylene alkyl ethers and polyoxyethylene alkenyl ethers.

In the case of using a surfactant, the total amount thereof to be used is preferably 0.1 part by mass or more, more preferably 0.5 part by mass or more, and is preferably 10 parts by mass or less, more preferably 5 parts by mass or less, even more preferably 3 parts by mass or less, relative to 100 parts by mass of the resin particles.

The dispersion of resin particles, the dispersion of colorant particles Z and the optional components may be mixed according to an ordinary method. Preferably, an aggregating agent is added to the mixed dispersion prepared by mixing them from the viewpoint of efficiently attaining the aggregation.

[Aggregating Agent]

Examples of the aggregating agent include organic aggregating agents such as a cationic surfactant in the form of a quaternary salt and polyethyleneimine; and inorganic aggregating agents. Examples of the inorganic aggregating agent include inorganic metal salts such as sodium sulfate, sodium nitrate, sodium chloride, calcium chloride, and calcium nitrate; inorganic ammonium salts such as ammonium sulfate, ammonium chloride, and ammonium nitrate; and divalent or higher metal complexes.

From the viewpoint of obtaining uniform aggregated particles having improved aggregating property, monovalent or higher and pentavalent or lower inorganic aggregating agents are preferred, monovalent or higher and divalent or lower inorganic metal salts and inorganic ammonium salts are more preferred, inorganic ammonium salts are even more preferred, and ammonium sulfate is further more preferred.

Using an aggregating agent, for example, an aggregating agent in an amount of 5 parts by mass or more and 50 parts by mass or less relative to the total amount, 100 parts by mass of resins is added to a mixed dispersion containing resin particles and colorant particles Z at 0° C. or higher and 40° C. or lower so that the resin particles and the colorant particles Z are aggregated in an aqueous medium to give aggregated particles. Further, from the viewpoint of accelerating aggregation, preferably, the temperature of the dispersion is increased after addition of the aggregating agent thereto.

At the time when the aggregated particles have grown to have a particle size suitable as toner particles, the aggregation may be stopped.

As a method of stopping aggregation, there are mentioned a method of cooling the dispersion, a method of adding an aggregation stopping agent, and a method of diluting the dispersion. From the viewpoint of surely preventing any unnecessary aggregation, a method of adding an aggregation stopping agent to stop aggregation is preferred.

[Aggregation Stopping Agent]

A surfactant is preferred as the aggregation stopping agent, and an anionic surfactant is more preferred. Examples of the anionic surfactant include alkylbenzenesulfonate salts, alkyl sulfate salts, alkyl ether sulfate salts, and polyoxyalkylene alkyl ether sulfate salts. One or more kinds of these may be used. The aggregation stopping agent may be added in the form of an aqueous solution thereof.

The amount of the aggregation stopping agent to be added is, from the viewpoint of surely preventing unnecessary aggregation, preferably 1 part by mass or more, more preferably 5 parts by mass or more, and is, from the viewpoint of reducing the agent from remaining in toner, preferably 60 parts by mass or less, more preferably 30 parts by mass or less, even more preferably 20 parts by mass or less, relative to 100 parts by mass of resin in the resin particles.

The volume median particle diameter $D_{50}$ of the aggregated particles is preferably 2 μm or more, more preferably 3 μm or more, even more preferably 4 μm or more, and is preferably 10 μm or less, more preferably 8 μm or less, even more preferably 6 μm or less. The volume median particle diameter $D_{50}$ of the aggregated particles is determined according to the method described in the section of Examples given hereinunder.

<Step 2>

In the step 2, for example, the aggregated particles are coalesced in an aqueous medium.

Accordingly, individual particles of the aggregated particles are coalesced to give coalesced particles.

The volume median particle diameter $D_{50}$ of the coalesced particles formed by coalescing is preferably 2 μm or more, more preferably 3 μm or more, even more preferably 4 μm or more, and is preferably 10 μm or less, more preferably 8 μm or less, even more preferably 6 μm or less.

The degree of circularity of the coalesced particles formed by coalescing is preferably 0.955 or more, more preferably 0.960 or more, and is preferably 0.990 or less, more preferably 0.985 or less, even more preferably 0.980 or less.

Preferably, coalescing is finished after having reached the above-mentioned preferred degree of circularity.

<Post-Treatment Step>

After the step 2, a post-treatment step may be carried out, and by isolating the coalesced particles, toner particles can be obtained. The coalesced particles formed in the step 2 exist in an aqueous medium, and are therefore processed for solid-liquid separation. For solid-liquid separation, a suction filtration method is preferably used.

After solid-liquid separation, the particles are preferably washed. At that time, preferably, the added surfactant is also removed, and therefore for the washing, an aqueous medium is preferably used at a temperature not higher than the clouding point of the surfactant. Preferably, washing is repeated plural times.

Next, drying is preferably carried out. Examples of the drying method include a vacuum low-temperature drying method, an oscillation-type fluidized drying method, a spray drying method, a freeze drying method, and a flush jet method.

[Toner Particles]

The volume median particle diameter $D_{50}$ of the toner particles is, from the viewpoint of giving high-quality images, and from the viewpoint of more improving the cleaning property of the toner, preferably 2 μm or more, more preferably 3 μm or more, even more preferably 4 μm or more, and is preferably 10 μm or less, more preferably 8 μm or less, even more preferably 6 μm or less.

The CV value of the toner particles is, from the viewpoint of improving toner productivity, preferably 12% or more, more preferably 14% or more, even more preferably 16% or more, and is, from the viewpoint of giving high-quality images, preferably 35% or less, more preferably 30% or less, even more preferably 26% or less, further more preferably 23% or less.

The volume median particle diameter $D_{50}$ and the CV value of the toner particles are measured according to the methods described in the section of Examples.

[Toner]

The toner contains the toner particles. The toner particles contain the above-mentioned resin A, addition polymer E and colorant. In this, the ratio by mass of the colorant to the addition polymer E is 50/50 or more and 95/5 or less. A preferred range of the ratio by mass of the colorant to the addition polymer E is as mentioned above.

[External Additive]

The toner particles may be used as a toner as they are, but preferably, those further processed by adding an external additive such as a fluidity enhancer to the surfaces of the toner particles are used as a toner.

Examples of the external additive include fine particles of an inorganic material such as hydrophobic silica, titanium oxide, alumina, cerium oxide, or carbon black, and polymer fine particles of polycarbonate, polymethyl methacrylate or silicone resin. Among these, hydrophobic silica is preferred.

In the case of surface treatment of the toner particles with an external additive, the amount of the external additive to be added is preferably 1 part by mass or more, more preferably 2 parts by mass or more, even more preferably 3 parts by mass or more, and is preferably 5 parts by mass or less, more preferably 4.5 parts by mass or less, even more preferably 4 parts by mass or less, relative to 100 parts by mass of the toner particles.

The toner is used for developing electrostatic images in electrophotographic printing. The toner can be used, for example, as a one-component developing agent, or as a two-component developing agent as mixed with a carrier.

When used in printing, the toner of the present invention can give images having high concealing performance with few image defects (voids). This can be considered to be as follows. Probably, the colorant can act also as a nucleating agent for crystallization of the crystalline polyester resin in the toner particles to improve the dispersibility of the colorant in the toner, and therefore many crystal domains of the crystalline polyester resin are formed and finely dispersed in the toner. As a result, the wet spreadability of the toner on the printing medium in fixation is bettered and accordingly the toner can realize higher concealing performance.

In the image formation method of the present invention, the contrast ratio of an image formed on standard paper in a toner deposition amount of 0.40±0.02 mg/cm$^2$ is preferably 93% or more, more preferably 94% or more, even more preferably 95% or more, and is preferably 100% or less. The contrast ratio of an image formed on standard paper (hereinafter may be referred to as "standard paper contrast ratio") can be determined by printing on standard paper using a toner and calculating the void area of the image after fixation, and specifically can be measured according to the method described in the section of Examples.

The image formation method of the present invention can be carried out using any toner, but when the toner produced according to the production method of the present invention or the toner of the present invention is used, the above-mentioned standard paper contrast ratio can be attained.

The image formation method of the present invention includes steps of a known image formation method using a toner for development of electrostatic images, and specifically includes at least a charging step of charging the surface of an image holder (photoreceptor), an electrostatic image formation step of forming an electrostatic image on the surface of the charged image holder, a development step of developing the electrostatic image formed on the surface of the image holder to be a toner image, a transfer step of transferring the toner image formed on the surface of the image holder onto the surface of a recording medium, and a fixation step of fixing the toner image transferred on the surface of the recording medium. In addition to these, the method may further have a cleaning step of removing the toner having remained on the surface of the image holder, and a toner supply step of supplying the toner removed in the cleaning step to the developing means.

Preferably, the toner of the present invention has a standard paper contrast ratio of 93% or more, more preferably 94% or more, even more preferably 95% or more, and is preferably 100% or less, more preferably 99.9% or less.

EXAMPLES

Hereinunder the present invention is described specifically with reference to Examples, but the present invention is not whatsoever restricted by these Examples. Property values were measured and evaluated according to the methods mentioned below.

In an expression of "alkylene oxide (X)" or the like, the parenthesized numerical value X means an average molar number of addition of an alkylene oxide.

[Measurement Methods]

[Acid Value and Hydroxyl Value of Resin and Wax]

The acid value and the hydroxyl value of resin and wax were measured according to a neutralization titration method described in JIS K 0070:1992. The solvent in measurement was chloroform.

[Softening Point, Crystallinity Index, Melting Point and Glass Transition Temperature of Resin]

(1) Softening Point

Using a flow tester "CFT-500D" (from Shimadzu Corporation), 1 g of a sample was extruded through a nozzle having a die pore diameter of 1 mm and a length of 1 mm while heating the sample at a heating rate of 6° C./minute and applying a load of 1.96 MPa thereto by a plunger. The softening point was determined as the temperature at which a half amount of the sample was flowed out when plotting a downward movement of the plunger of the flow tester relative to the temperature.

(2) Crystallinity Index

Using a differential scanning calorimeter "Q100" (from TA Instruments Japan Inc.), 0.02 g of a sample was weighed in an aluminum pan and cooled down to 0° C. at a cooling rate of 10° C./min. Next, the sample was kept as such for 1 minute, and thereafter heated up to 180° C. at a heating rate of 10° C./min to measure the quantity of heat thereof. Among the detected endothermic peaks, a peak temperature at which the peak area is the largest is referred to as a maximum peak temperature (1), and according to (softening point (° C.))/(endothermic maximum peak temperature (1) (° C.)), the crystallinity index was determined.

(3) Melting Point and Glass Transition Temperature

Using a differential scanning calorimeter "Q100" (from TA Instruments Japan Inc.), 0.02 g of a sample was weighed in an aluminum pan, heated up to 200° C., and then cooled from the temperature down to 0° C. at a cooling rate of 10° C./min. Next, the sample was heated at a heating rate of 10° C./min to measure the quantity of heat thereof. Among the detected endothermic peaks, a peak temperature at which the peak area is the largest is referred to as an endothermic maximum peak temperature (2). In the case of a crystalline resin, the peak temperature is the melting point thereof.

In the case of an amorphous resin that gave a peak, the peak temperature is the glass transition temperature thereof, but in the case where the amorphous resin did not give a peak but showed steps, a temperature at the intersection point between the tangent line that shows a maximum inclination of the curve of the stepped part and the base line on the low temperature side of the steps is referred to as a glass transition temperature of the resin.

[Weight-Average Molecular Weight of Addition Polymer]

An eluent solution was prepared by dissolving phosphoric acid and lithium bromide in N,N-dimethylformamide to have a concentration of 60 mmol/L and 50 mmol/L, respectively, therein. Using the eluent solution, a sample was analyzed through gel permeation chromatography [GPC apparatus "HLC-8320GPC" (from Tosoh Corporation), column "TSKgel Super AWM-H, TSKgel Super AW3000, TSKgel guard column Super AW-H" (from Tosoh Corporation), flow rate: 0.5 mL/min], based on a monodispersed polystyrene kit having a known molecular weight as a standard substance [PSt Quick B (F-550, F-80, F-10, F-1, A-1000), PSt Quick C (F-288, F-40, F-4, A-5000, A-500), from Tosoh Corporation].

[Melting Point of Wax]

Using a differential scanning calorimeter "Q100" (from TA Instruments Japan Inc.), 0.02 g of a sample was weighed in an aluminum pan, heated up to 200° C., and then cooled from 200° C. down to 0° C. at a cooling rate of 10° C./min. Next, the sample was heated at a heating rate of 10° C./min to measure the quantity of heat thereof, and the endothermic maximum peak temperature is referred to as the melting point of the sample.

[Volume Median Particle Diameter $D_{50}$ and CV Value of Resin Particles, Colorant Particles and Wax Particles]

(1) Measuring Apparatus: Laser diffraction particle size analyzer "LA-920" (from HORIBA Ltd.)

(2) Measuring Conditions: In a cell for the measurement, a sample dispersion was put, distilled water was added thereto, and at a concentration at which the absorbance could fall within an appropriate range, the volume median particle diameter ($D_{50}$) and the volume-average particle size $D_v$ of the sample were measured. The CV value was calculated according to the following expression.

$$CV \text{ value } (\%) = (\text{standard deviation of particle size distribution/volume-average particle size } D_v) \times 100$$

[Solid Concentration in Resin Particle Dispersion, Colorant Particle Dispersion and Wax Particle Dispersion]

Using an infrared moisture meter "FD-230" (from Kett Electric Laboratory), 5 g of a sample to be measured was dried at a drying temperature of 150° C. under a measuring mode 96 (monitoring time: 2.5 minutes, moisture variation range: 0.05%), and then subjected to measurement of a water content (% by mass) of the sample. The solid concentration was calculated according to the following expression.

$$\text{Solid concentration } (\% \text{ by mass}) = 100 - \text{water content } (\% \text{ by mass})$$

[Volume Median Particle Diameter $D_{50}$ of Aggregated Particles]

The volume median particle diameter $D_{50}$ of aggregated particles was measured by the following method.

Measuring Apparatus: "Coulter Multisizer (registered trademark) III" (from Beckman Coulter Inc.)

Aperture Diameter: 50 μm

Analyzing Software: "Multisizer (registered trademark) III version 3.51" (from Beckman Coulter Inc.)

Electrolyte Solution: "Isotone (registered trademark) II" (from Beckman Coulter Inc.)

Measuring Conditions:

A sample dispersion was added to 100 mL of the above-mentioned electrolyte solution to control the concentration thereof so as to complete the measurement for particle sizes of 30,000 particles within 20 seconds, then the particle sizes of the 30,000 particles in the dispersion were measured, and the volume median particle diameter $D_{50}$ of the particles was determined from the particle size distribution thereof.

[Degree of Circularity of Coalesced Particles]

The degree of circularity of coalesced particles was measured under the following conditions.

Measuring Apparatus: Flow-type particle image analyzer "FPIA-3000" (from Sysmex Corporation)

Preparation of Dispersion:

A dispersion of coalesced particles was prepared by diluting the particles with deionized water to have a solid concentration of 0.001 to 0.05% by mass.

Measuring Mode: HPF measuring mode

[Volume Median Particle Diameter $D_{50}$ and CV Value of Toner Particles]

The volume median particle diameter $D_{50}$ of toner particles was measured as follows.

The measuring apparatus, the aperture diameter, the analyzing software and the electrolyte solution were the same as those used for measurement of the volume median particle diameter $D_{50}$ of aggregated particles mentioned above.

Dispersion:

Polyoxyethylene lauryl ether "Emulgen (registered trademark) 109P" (from Kao Corporation, HLB (hydrophile-lipophile balance)=13.6) was dissolved in the above-mentioned electrolyte solution to prepare a dispersion having a concentration of 5% by mass.

Dispersing Conditions:

10 mg of a sample for measurement of dried toner particles was added to 5 mL of the above-mentioned dispersion, and dispersed for 1 minute using an ultrasonic disperser, and thereafter 25 mL of the above-mentioned electrolyte solution was added thereto and further dispersed for 1 minute with the ultrasonic disperser to prepare a sample dispersion.

Measuring Conditions:

The sample dispersion was added to 100 mL of the above-mentioned electrolyte solution to control the concentration thereof so as to complete the measurement for particle sizes of 30,000 particles within 20 seconds, then the particle sizes of the 30,000 particles were measured, and the volume median particle diameter $D_{50}$ and the volume-average particle size $D_v$ of the particles were determined from the particle size distribution thereof.

The CV value (%) was calculated according to the following expression.

$$CV \text{ value } (\%) = (\text{standard deviation of particle size distribution}/\text{volume-average particle size } D_v) \times 100$$

[Evaluation Methods]

[Image Density of Prints]

First, according to the following fixing test, a lowest fixing temperature (1) was preset.

Using a commercially-available printer "Microline (registered trademark) 5400" (from Oki Data Corporation), a solid image was outputted but not fixed on high-quality paper "J Paper A4 Size" (from Fuji Xerox Corporation) in such a manner that the toner deposition amount on the paper could be 1.48 to 1.52 mg/cm$^2$ in a length of 50 mm with a blank space of 5 mm from the top of the A4 paper left to remain as such.

Next, the same printer in which the fixing device had been modified to be applicable to a varying temperature was prepared, then the temperature of the fixing machine was set at 110° C., and the toner was fixed at a speed of 1.2 seconds/paper in the lengthwise direction of the A4 paper to give prints.

In the same manner but the temperature of the fixing device was elevated at intervals of 5° C., the toner was fixed also to give prints.

From the blank space at the top of the image to the solid image on the print, a mending tape "Scotch (registered trademark) Mending Tape 810" (from Sumitomo 3M Corporation, width 18 mm) cut in a size of 50 mm was lightly adhered to the print, then a columnar weight of 500 g (contact area 157 mm$^2$) was put on it, and pressed for one back-and-forth movement at a speed of 10 mm/s. Subsequently, the adhered tape was peeled from the bottom side at a peeling angle of 180° and at a speed of 10 mm/s to give a tape-peeled print. 30 sheets of high-quality paper "Excellent White Paper A4 Size" (from Oki Data Corporation) were laid below the print before the tape was adhered and after the tape was peeled, and the reflection image density of the fixed image part of each print before tape adhesion and after tape peeling was measured using a colorimeter "Spectro Eye" (from Gretag Macbeth Corporation, light incidence condition: standard light source D50, observation viewing field 2°, density standard DINNB, absolute white standard). From the reflection image density, the fixation ratio was calculated according to the following expression.

$$\text{Fixation Ratio } (\%) = (\text{reflection image density after tape peeling}/\text{reflection image density before tape adhering}) \times 100$$

The temperature at which the fixation ratio is 90% or more is referred to as a lowest fixing temperature (1).

Next, using a commercially-available printer "Microline (registered trademark) 5400" (from Old Data Corporation), a solid image was outputted on high-quality paper "J Paper A4 Size" (from Fuji Xerox Corporation) in such a manner that the toner deposition amount on the paper could be 0.25 mg/cm$^2$.

The temperature of the fixing device was set at a temperature+10° C. of the lowest fixing temperature (1) determined in the above-mentioned fixing test, and the toner was fixed at a speed of 1.2 second/paper in the lengthwise direction of the A4 paper to give prints.

30 sheets of high-quality paper "Excellent White Paper A4 Size" (from Oki Data Corporation) were laid below the print, and the reflection image density of the solid image part of the outputted print was measured using a colorimeter "Spectro Eye" (from Gretag Macbeth Corporation, light incidence condition: standard light source D50, observation viewing field 2°, density standard DINNB, absolute white standard). The data measured at arbitrary 10 points on the image were averaged to be an image density. A larger numerical value means a more excellent image density.

[Standard Paper Contrast Ratio]

First, according to the following fixing test, a lowest fixing temperature (2) was preset.

Using a commercially-available printer "C712dnw" (from Old Data Corporation), a solid image of 3 cm×4 cm was outputted but not fixed on high-quality paper "J Paper A4 Size" (from Fuji Xerox Corporation) in such a manner that the toner deposition amount on the paper could be 0.40±0.02 mg/cm$^2$ (unfixed image).

Next, the same printer in which the fixing device had been modified to be applicable to a varying temperature was prepared, then the temperature of the fixing machine was set at 70° C., and the toner was fixed at a speed of 15 sheets/min (75 mm/s) in the lengthwise direction of the A4 paper to give prints.

In the same manner but the temperature of the fixing device was elevated at intervals of 5° C., the toner was fixed also to give prints.

From the blank space at the top of the image to the solid image on the print, a mending tape "Scotch (registered trademark) Mending Tape 810" (from Sumitomo 3M Corporation, width 18 mm) cut in a size of 50 mm was lightly adhered to the print, then a columnar weight of 500 g (contact area 157 mm$^2$) was put on it, and pressed for one back-and-forth movement at a speed of 10 mm/s. Subsequently, the adhered tape was peeled from the bottom side at a peeling angle of 180° and at a speed of 10 mm/s to give a tape-peeled print. 30 sheets of high-quality paper "Excellent White Paper A4 Size" (from Oki Data Corporation) were laid below the print before the tape was adhered and after the tape was peeled, and the reflection image density of the fixed image part of each print before tape adhesion and after tape peeling was measured using a colorimeter "Spectro Eye" (from Gretag Macbeth Corporation, light incidence condition: standard light source D50, observation viewing field 2°, density standard DINNB, absolute white standard). From the reflection image density, the fixation ratio was calculated according to the following expression.

Fixation Ratio (%)=(reflection image density after tape peeling/reflection image density before tape adhering)×100

The temperature at which the fixation ratio is 90% or more is referred to as a lowest fixing temperature (2).

Subsequently, the fixing temperature of the fixing device was set at a temperature+10° C. of the lowest fixing temperature (2) determined in the above-mentioned fixing test, and the same unfixed image as above (solid image of 3 cm×4 cm having a toner deposition amount 0.40±0.02 mg/cm$^2$) was fixed at a speed of 15 sheets/min (75 mm/s) in the lengthwise direction of the A4 paper to give prints.

Using a microscope "DSX510" (from Olympus Corporation), a 208-power image was taken on the prints by transmitted light observation via a 50-power objective lens, at an exposure of 50 ms, and an ISO sensitivity of 200 with no contrast. Subsequently, using the analysis software attached to the microscope DSX510, the data were binarized to calculate the void area ratio of the solid image with an optical reference (red) and at a threshold value of 56 and small particle removal of 5 μm$^2$. According to the following expression, the standard paper contrast ratio was calculated.

Standard paper contrast ratio (%)=100−void area ratio (%)

Production of Resin

Production of Amorphous Resin

Production Example A1

Production of Resin A-1

The inside of a four-neck flask having an internal volume of 10 L and equipped with a nitrogen inlet tube, a dewatering tube, a stirrer and a thermocouple was purged with nitrogen, and 3,253 g of propylene oxide (2.2) adduct of bisphenol A, 1,003 g of terephthalic acid, 25 g of tin(II) di(2-ethylhexanoate), 2.5 g of 3,4,5-trihydroxybenzoic acid and 394 g of hydrocarbon wax W1 "Paracol 6490" (from Nippon Seiro Co., Ltd.) were put thereinto, and heated up to 235° C. with stirring in a nitrogen atmosphere, then kept at 235° C. for 8 hours, and the pressure inside the flask was lowered, and was kept at 8 kPa for 1 hour. Subsequently, the flask was restored to an atmospheric pressure, then cooled down to 160° C., and while kept at 160° C., a mixture of 2,139 g of styrene, 535 g of stearyl methacrylate, 107 g of acrylic acid and 321 g of dibutyl peroxide was dropwise added thereto taking 3 hours. Subsequently, this was kept at 160° C. for 30 minutes, then heated up to 200° C., and the pressure inside the flask was further lowered and kept at 8 kPa for 1 hour. Subsequently, this was restored to an atmospheric pressure, cooled down to 190° C., then 129 g of fumaric acid, 94 g of sebacic acid, 214 g of trimellitic anhydride and 2.5 g of 4-tert-butylcatechol were added, then heated up to 210° C. at a rate of 10° C./hr, and thereafter reacted at 4 kPa to a desired softening point to give a resin A-1. The properties are shown in Table 1.

Production Examples A2 to A4

Production of Resins A-2 to A-4

Resins A-2 to A-4 were produced in the same manner as in Production Example A1 except that the raw material compositions were changed as shown in Table 1. The properties are shown in Table 1.

Production Example A5

Production of Resin A-5

The inside of a four-neck flask having an internal volume of 10 L and equipped with a nitrogen inlet tube, a dewatering tube, a stirrer and a thermocouple was purged with nitrogen, and 5,632 g of propylene oxide (2.2) adduct of bisphenol A, 1,736 g of terephthalic acid, 40 g of tin(II) di(2-ethylhexanoate), and 4.0 g of 3,4,5-trihydroxybenzoic acid were put thereinto, and heated up to 235° C. with stirring in a nitrogen atmosphere, then kept at 235° C. for 10 hours, and the pressure inside the flask was lowered, and was kept at 8 kPa for 1 hour. Subsequently, the flask was restored to an atmospheric pressure, then cooled down to 190° C., and 325 g of sebacic acid and 371 g of trimellitic anhydride were added thereto, heated up to 210° C. at a rate of 10° C./hr, and thereafter the pressure inside the flask was lowered, and these were reacted at 10 kPa to a desired softening point to give a resin A-5. The properties are shown in Table 1.

Production Example D1

Production of Resin D-1

The inside of a four-neck flask having an internal volume of 10 L and equipped with a nitrogen inlet tube, a dewatering tube, a stirrer and a thermocouple was purged with nitrogen, and 4,313 g of propylene oxide (2.2) adduct of bisphenol A, 818 g of terephthalic acid, 727 g of succinic acid, 30 g of tin(II) di(2-ethylhexanoate), and 3.0 g of 3,4,5-trihydroxybenzoic acid were put thereinto, and heated up to 235° C. with stirring in a nitrogen atmosphere, then kept at 235° C. for 5 hours, and the pressure inside the flask was lowered, and was kept at 8 kPa for 1 hour. Subsequently, the flask was restored to an atmospheric pressure, then cooled down to 160° C., and while kept at 160° C., a mixture of 2,756 g of styrene, 689 g of stearyl methacrylate, 142 g of acrylic acid, and 413 g of dibutyl peroxide was dropwise added thereto taking 1 hour. Subsequently, this was kept at 160° C. for 30 minutes, then heated up to 200° C., and thereafter the pressure inside the flask was lowered, and these were reacted at 8 kPa to a desired softening point to give a resin D-1. The properties are shown in Table 1.

TABLE 1

| | | | Production Example A1 | | Production Example A2 | | Production Example A3 | |
|---|---|---|---|---|---|---|---|---|
| | Resin A | | A-1 | | A2 | | A-3 | |
| | | | charged amount (g) | part by mol *2 | charged amount (g) | part by mol *2 | charged amount (g) | part by mol *2 |
| Raw Material Monomer (P) for polyester resin segment | Alcohol Component | BPA-PO *1 | 3,253 | 100 | 4,379 | 100 | 3,253 | 100 |
| | Carboxylic Acid Component | terephthalic acid | 1,003 | 65 | 1,350 | 65 | 1,003 | 65 |
| | | fumaric acid | 129 | 12 | 174 | 12 | 129 | 12 |
| | | succinic acid | — | — | — | — | — | — |
| | | sebacic acid | 94 | 5 | 126 | 5 | 94 | 5 |
| | | trimellitic anhydride | 214 | 12 | 288 | 12 | 214 | 12 |
| Bireactive Monomer | acrylic acid | | 107 | 16 | 72 | 8 | 107 | 16 |
| | | | charged amount (g) | % by mass *3 | charged amount (g) | % by mass *3 | charged amount (g) | % by mass *3 |
| Raw Material Monomer (V) for addition polymer resin segment | styrene | | 2,139 | 80 | 1,068 | 80 | 2,139 | 80 |
| | stearyl methacrylate | | 535 | 20 | 267 | 20 | — | — |
| | 2-ethylhexyl acrylate | | — | — | — | — | 535 | 20 |
| | butyl acrylate | | — | — | — | — | — | — |
| | | | charged amount (g) | part by mol *4 | charged amount (g) | part by mol *4 | charged amount (g) | part by mol *4 |
| Hydrocarbon Wax (W1) | Paracol 6490 *5 | | 394 | 5 | 394 | 5 | 394 | 5 |
| Esterification Catalyst | tin(II) di(2-ethylhexanoate) (g) | | 25 | | 33 | | 25 | |
| Esterification Promoter | 3,4,5-trihydroxybenzoic acid (g) | | 2.5 | | 3.3 | | 2.5 | |
| Radical Poly-merization Initiator | dibutyl peroxide (g) | | 321 | | 160 | | 321 | |
| Radical Poly-merization Inhibitor | 4-tert-butylcatechol (g) | | 2.5 | | 3.3 | | 2.5 | |
| Amount of addition polymer resin segment (% by mass) *6 | | | 40 | | 20 | | 40 | |
| Properties | Softening Point (° C.) | | 122 | | 120 | | 120 | |
| | Glass Transition Temperature (° C.) | | 55 | | 55 | | 55 | |
| | Crystallinity Index | | 1.9 | | 1.9 | | 1.9 | |
| | Acid Value (mgKOH/g) | | 20 | | 20 | | 20 | |
| | Resin A | | Production Example A4 A-4 | | Production Example A5 A-5 | | Production Example D1 D-1 | |
| | | | charged amount (g) | part by mol *2 | charged amount (g) | part by mol *2 | charged amount (g) | part by mol *2 |
| Raw Material Monomer (P) | Alcohol Component | BPA-PO *1 | 3,253 | 100 | 5,632 | 100 | 4,313 | 100 |

TABLE 1-continued

| | | | | | | | | |
|---|---|---|---|---|---|---|---|---|
| for polyester resin segment | Carboxylic Acid Component | terephthalic acid | 1,003 | 65 | 1,736 | 65 | 818 | 40 |
| | | fumaric acid | 129 | 12 | — | — | — | — |
| | | succinic acid | — | — | — | — | 727 | 50 |
| | | sebacic acid | 94 | 5 | 325 | 10 | — | — |
| | | trimellitic anhydride | 214 | 12 | 371 | 12 | — | — |
| Bireactive Monomer | acrylic acid | | 107 | 16 | — | — | 142 | 16 |
| | | | charged amount (g) | % by mass *3 | charged amount (g) | % by mass *3 | charged amount (g) | % by mass *3 |
| Raw Material Monomer (V) for addition polymer resin segment | styrene | | 2,139 | 80 | — | — | 2,756 | 80 |
| | stearyl methacrylate | | — | — | — | — | 689 | 20 |
| | 2-ethylhexyl acrylate | | — | — | — | — | — | — |
| | butyl acrylate | | 535 | 20 | — | — | — | — |
| | | | charged amount (g) | part by mol *4 | charged amount (g) | part by mol *4 | charged amount (g) | part by mol *4 |
| Hydrocarbon Wax (W1) | Paracol 6490 *5 | | 394 | 5 | — | — | — | — |
| Esterification Catalyst | tin(II) di(2-ethylhexanoate) (g) | | 25 | | 40 | | 30 | |
| Esterification Promoter | 3,4,5-trihydroxybenzoic acid (g) | | 2.5 | | 4.0 | | 3.0 | |
| Radical Poly-merization Initiator | dibutyl peroxide (g) | | 321 | | — | | 413 | |
| Radical Poly-merization Inhibitor | 4-tert-butylcatechol (g) | | 2.5 | | — | | — | |
| Amount of addition polymer resin segment (% by mass) *6 | | | 40 | | 0 | | 40 | |
| Properties | Softening Point (° C.) | | 120 | | 121 | | 91 | |
| | Glass Transition Temperature (° C.) | | 55 | | 54 | | 42 | |
| | Crystallinity Index | | 1.9 | | 1.9 | | 1.8 | |
| | Acid Value (mgKOH/g) | | 21 | | 22 | | 24 | |

*1 BPA-PO means propylene oxide (2.2) adduct of bisphenol A.

*2 This means part by mol of each monomer constituting the raw material monomer (P) and the bireactive monomer, based on the alcohol component of the raw material monomer (P) as 100 parts by mol.

*3 This means a content (% by mass) of each monomer constituting the raw material monomer (V) in the total amount of the raw material monomer (V).

*4 This means a content (part by mass) of the hydrocarbon wax (W1) relative to the total amount, 100 parts by mass of the raw material monomer (P) and the raw material monomer (V).

*5 Paracol 6490: from Nippon Seiro Co., Ltd., Mn 800, melting point 76° C., acid value 18 mgKOH/g, hydroxyl value 97 mgKOH/g

*6 In calculation, the polyester resin segment amount is a theoretical yield excluding the amount of water due to dehydration in polycondensation, and the addition polymer resin segment amount includes the radical polymerization initiator amount.

Production of Crystalline Resin

Production Example B1

Production of Resin B-1

The inside of a four-neck flask having an internal volume of 10 L and equipped with a nitrogen inlet tube, a dewatering tube, a stirrer and a thermocouple was purged with nitrogen, and 3,416 g of 1,10-decanediol and 4,084 g of sebacic acid were put thereinto, and heated up to 135° C. with stirring, then kept at 135° C. for 3 hours, and further heated from 135° C. up to 200° C. taking 10 hours. Subsequently, 23 g of tin(II) di(2-ethylhexanoate) was added, further kept at 200° C. for 1 hour, and thereafter the pressure inside the flask was lowered, and then kept at a reduced pressure of 8.3 kPa for 1 hour to give a resin B-1. The properties are shown in Table 2.

Production Example B2

Production of Resin B-2

A resin B-2 was produced in the same manner as in Production Example B1 except that the raw material compositions were changed as shown in Table 2. The properties are shown in Table 2.

Production Example B3

Production of Resin B-3

The inside of a four-neck flask equipped with a nitrogen inlet tube, a dewatering tube, a stirrer and a thermocouple was purged with nitrogen, and 4,500 g of 1,10-decanediol, 3,000 g of fumaric acid and 5 g of 4-tert-butylcatechol were put thereinto. With stirring, this was heated up to 145° C., kept at 145° C. for 3 hours, and then further heated from 145° C. up to 200° C. taking 10 hours. Subsequently, 25 g of tin di(2-ethylhexanoate) was added, further kept at 200° C. for 1 hour, and thereafter the pressure inside the flask was lowered, and then kept at a reduced pressure of 8.3 kPa for 4 hours to give a resin B-3. The properties are shown in Table 2.

TABLE 2

| | | | Production Example B1 | | Production Example B2 Resin B | | Production Example B3 | |
|---|---|---|---|---|---|---|---|---|
| | | | B-1 | | B-2 | | B-3 | |
| | | | charged amount (g) | part by mol *1 | charged amount (g) | part by mol *1 | charged amount (g) | part by mol *1 |
| Raw Material Monomer for Polyester Resin | Alcohol Component | 1,4-butanediol | — | — | 1,898 | 100 | — | — |
| | | 1,10-decanediol | 3,416 | 100 | — | — | 4,500 | 100 |
| | Carboxylic Acid Component | fumaric acid | — | — | — | — | 3,000 | 100 |
| | | sebacic acid | 4,084 | 103 | — | — | — | — |
| | | tetradecanedioic acid | — | — | 5,603 | 103 | — | — |
| Esterification Catalyst | tin(II) di(2-ethylhexanoate) (g) | | 23 | | 23 | | 25 | |
| Radical Polymerization Inhibitor | 4-tert-butylcatechol (g) | | — | | — | | 5 | |
| Properties | Softening Point (° C.) | | 88 | | 87 | | 92 | |
| | Melting Point (° C.) | | 77 | | 79 | | 91 | |
| | Crystallinity Index | | 1.1 | | 1.1 | | 1.0 | |
| | Acid Value (mgKOH/g) | | 17 | | 20 | | 18 | |

*1 This means part by mol of each monomer constituting the raw material monomer based on the alcohol component of the raw material monomer as 100 parts by mol.

Production of Resin Particle Dispersion

Production Example X1

Production of Resin Particle Dispersion X-1

300 g of the resin A-1, 360 g of methyl ethyl ketone and 59 g of deionized water were put into a container having an internal volume of 3 L and equipped with a stirrer, a reflux condenser, a dropping funnel, a thermometer and a nitrogen inlet tube, and the resin was dissolved at 73° C. taking 2 hours. An aqueous solution of 5 mass % sodium hydroxide was added to the resultant solution so that the degree of neutralization could be 50 mol % relative to the acid value of the resin, and stirred for 30 minutes.

Next, while kept at 73° C. and stirring at 280 r/min (peripheral speed 88 m/min), 600 g of deionized water was added taking 60 minutes for transfer-phase emulsification. Still continuously kept at 73° C., methyl ethyl ketone was evaporated away under reduced pressure to give an aqueous dispersion. Subsequently, with stirring at 280 r/min (peripheral speed 88 m/min), the aqueous dispersion was cooled to 30° C., and then deionized water was added to have a solid concentration of 20% by mass, thereby preparing a resin particle dispersion X-1. The volume median particle diameter $D_{50}$ and the CV value of the resultant resin particles are shown in Table 3.

Production Examples X2 to X5

Production of Resin Particle Dispersions X-2 to X-5

Resin particle dispersions X-2 to X-5 were produced in the same manner as in Production Example X1 except that the kind of the resin to be used was changed as in Table 3. The volume median particle diameter $D_{50}$ and the CV value of the resultant resin particles are shown in Table 3.

Production Example XY1

Production of Resin Particle Dispersion XY-1

210 g of the resin A-1, 90 g of the resin B-1, 300 g of methyl ethyl ketone and 49 g of deionized water were put into a container having an internal volume of 3 L and equipped with a stirrer, a reflux condenser, a dropping funnel, a thermometer and a nitrogen inlet tube, and the resins were dissolved at 73° C. taking 2 hours. An aqueous solution of 5 mass % sodium hydroxide was added to the resultant solution so that the degree of neutralization could be 50 mol % relative to the acid value of the resin, and stirred for 30 minutes.

Next, while kept at 73° C. and stirring at 280 r/min (peripheral speed 88 m/min), 600 g of deionized water was added taking 60 minutes for transfer-phase emulsification. Still continuously kept at 73° C., methyl ethyl ketone was evaporated away under reduced pressure to give an aqueous dispersion. Subsequently, with stirring at 280 r/min (peripheral speed 88 m/min), the aqueous dispersion was cooled to 30° C., and then deionized water was added to have a solid concentration of 20% by mass, thereby preparing a resin particle dispersion XY-1. The volume median particle diameter $D_{50}$ and the CV value of the resultant resin particles are shown in Table 3.

Production Example Y1

Production of Resin Particle Dispersion Y-1

300 g of the resin B-1, and a mixed solvent of 300 g of methyl ethyl ketone and 41 g of deionized water were put into a container having an internal volume of 3 L and equipped with a stirrer, a reflux condenser, a dropping funnel, a thermometer and a nitrogen inlet tube, and the resin was dissolved at 73° C. taking 2 hours. An aqueous solution of 5 mass % sodium hydroxide was added to the resultant solution so that the degree of neutralization could be 55 mol % relative to the acid value of the resin B-1, and stirred for 30 minutes.

Next, while kept at 73° C. and stirring at 280 r/min (peripheral speed 88 m/min), 600 g of deionized water was added taking 60 minutes for transfer-phase emulsification. Still continuously kept at 73° C., methyl ethyl ketone was evaporated away under reduced pressure to give an aqueous dispersion. Subsequently, with stirring at 280 r/min (peripheral speed 88 m/min), the aqueous dispersion was cooled to 30° C., and then deionized water was added to have a solid concentration of 20% by mass, thereby preparing an aqueous dispersion Y-1 of resin particles. The properties are shown in Table 3.

Production Examples Y2 and Y3

Production of Resin Particle Dispersions Y-2 and Y-3

Resin particle dispersions Y-2 and Y-3 were produced in the same manner as in Production Example Y1 except that the kind of the resin to be used was changed as in Table 3. The volume median particle diameter $D_{50}$ and the CV value of the resultant resin particles are shown in Table 3.

Production Example P1

Production of Resin Particle Dispersion P-1

200 g of the resin D-1, and 200 g of methyl ethyl ketone were put into a container having an internal volume of 3 L and equipped with a stirrer, a reflux condenser, a dropping funnel, a thermometer and a nitrogen inlet tube, and the resin was dissolved at 73° C. taking 2 hours. An aqueous solution of 5 mass % sodium hydroxide was added to the resultant solution so that the degree of neutralization could be 60 mol % relative to the acid value of the resin D-1, and stirred for 30 minutes.

Next, while kept at 73° C. and stirring at 280 r/min (peripheral speed 88 m/min), 700 g of deionized water was added taking 50 minutes for transfer-phase emulsification. Still continuously kept at 73° C., methyl ethyl ketone was evaporated away under reduced pressure to give an aqueous dispersion. Subsequently, with stirring at 280 r/min (peripheral speed 88 m/min), the aqueous dispersion was cooled to 30° C., and then deionized water was added to have a solid concentration of 20% by mass, thereby preparing a resin particle dispersion P-1. The volume median particle diameter D50 of the resultant resin particles was 0.09 lam and the CV value thereof was 23%.

Production of Wax Particle Dispersion

Production Example W1

Production of Wax Particle Dispersion W-1

120 g of deionized water, 86 g of the resin particle dispersion P-1 and 40 g of paraffin wax "HNP-9" (from Nippon Seiro Co., Ltd., melting point: 75° C.) were added

TABLE 3

| | Production Example | | | | | |
|---|---|---|---|---|---|---|
| | Production Example X1 | Production Example X2 | Production Example X3 | Production Example X4 | Production Example X5 | Production Example XY1 |
| Resin Particle Dispersion | X-1 | X-2 | X-3 | X-4 | X-5 | XY-1 |
| Resin A *1 | A-1 | A-2 | A-3 | A-4 | A-5 | A-1 (70) |
| Resin B *1 | — | — | — | — | — | B-1 (30) |
| Volume Median Particle Diameter $D_{50}$(μM) | 0.22 | 0.21 | 0.21 | 0.18 | 0.13 | 0.18 |
| CV Value (%) | 26 | 25 | 26 | 24 | 23 | 26 |

| | Production Example | | |
|---|---|---|---|
| | Production Example Y1 | Production Example Y2 | Production Example Y3 |
| Resin Particle Dispersion | Y-1 | Y-2 | Y-3 |
| Resin B | B-1 | B-2 | B-3 |
| Volume Median Particle Diameter $D_{50}$(μM) | 0.15 | 0.14 | 0.18 |
| CV Value (%) | 26 | 26 | 27 |

*1 The parenthesized value is a charged amount (part by mass).

to a beaker having an internal volume of 1 L, and melted while kept at a temperature of 90 to 95° C., then stirred to give a molten mixture.

While further kept at a temperature of 90 to 95° C., the resultant molten mixture was dispersed for 20 minutes, using an ultrasonic homogenizer "US-600T" (from Nihon-seiki Kaisha, Ltd.), and then cooled down to room temperature (20° C.). Deionized water was added to make the solid concentration 20% by mass to give a wax particle dispersion W-1. The volume median particle diameter $D_{50}$ of the wax particles in the dispersion was 0.47 μm and the CV value thereof was 27%.

Production Example W2

Production of Wax Particle Dispersion W-2

A wax particle dispersion W-2 was produced in the same manner as in Production Example W1 except that the type of the wax to be used was changed to Fischer-Tropsch wax "FNP-0090" (from Nippon Seiro Co., Ltd., melting point 90° C.). The volume median particle diameter $D_{50}$ of the wax particles in the dispersion was 0.45 μm and the CV value thereof was 28%.

to E-3. The weight-average molecular weight of the resultant addition polymers is shown in Table 4.

Production Example E4

Synthesis of Addition Polymer E-4

An addition polymer E-4 was produced in the same manner as in Production Example E1 except that 2-mercaptoethanol was not added at all. The weight-average molecular weight thereof was measured according to the above-mentioned method, and shown in Table 4.

Production Example E5

Synthesis of Addition Polymer E-5

An addition polymer E-5 was produced in the same manner as in Production Example E 1 except that the amount of 2-mercaptoethanol in the reactor was changed from 0.03 g to 0.06 g and the amount of 2-mercaptoethanol in the dropping funnel was changed from 0.27 g to 0.54 g. The weight-average molecular weight thereof was measured according to the above-mentioned method, and shown in Table 4.

TABLE 4

| Addition Polymer | | Production Example E1 E-1 | Production Example E2 E-2 | Production Example E3 E-3 | Production Example E4 E-4 | Production Example E5 E-5 |
|---|---|---|---|---|---|---|
| Raw Material Monomer (g) | methacrylic acid | 16 | 16 | 16 | 16 | 16 |
| | styrene | 44 | 44 | 59 | 44 | 44 |
| | benzyl methacrylate | — | 15 | 25 | — | — |
| | styrene macromonomer *1 | 15 | — | — | 15 | 15 |
| | methoxypolyethylene glycol methacrylate *2 | 25 | 25 | — | 25 | 25 |
| Properties | weight-average molecular weight | 50,000 | 45,000 | 55,000 | 89,000 | 32,000 |

*1 "AS-6S": from Toagosei Co., Ltd., number-average molecular weight 6,000, solid concentration 50% by mass. The blending amount in the Table is a solid content-based blending amount.
*2 "Blemmer PME-200": from NOF Corporation (number of mole of ethylene oxide added, about 4)

Production of Addition Polymer

Production Examples E1 to E3

Synthesis of Addition Polymers E-1 to E-3

Raw material monomers as in Table 4 showing the kind and the amount thereof were mixed to prepare a monomer mixture having a monomer total amount of 100 g.

The inside of a four-neck flask equipped with a nitrogen inlet tube, a dropping funnel, a stirrer and a thermocouple was purged with nitrogen, then 18 g of methyl ethyl ketone, 0.03 g of 2-mercaptoethanol and 10% by mass of the monomer mixture were put thereinto and heated up to 75° C. with stirring. While kept at 75° C., a mixture of 90% by mass of the remaining monomer mixture, 0.27 g of 2-mercaptoethanol, 42 g of methyl ethyl ketone and 3 g of 2,2'-azobis (2,4-dimethylvaleronitrile) "V-65" (from Wako Pure Chemical Corporation) was dropwise added via the dropping funnel taking 3 hours. After the dropwise addition, this was kept at 75° C. for 2 hours, and then a solution prepared by dissolving 3 g of V-65 in 5 g of methyl ethyl ketone was added, and further kept at 75° C. for 2 hours and 80° C. for 2 hours. Subsequently, methyl ethyl ketone was evaporated away under reduced pressure to give addition polymers E-1

Production of Colorant Particle Dispersion

Production Example Z1

Production of Colorant Particle Dispersion Z-1

75 g of the addition polymer E-1 and 630 g of methyl ethyl ketone were put into a container having an internal volume of 5 L and equipped with a stirrer with a disper blade, a reflux condenser, a dropping funnel, a thermometer and a nitrogen inlet tube, and the resin was dissolved at 20° C. 101 g of an aqueous solution of 5 mass % sodium hydroxide (to make the addition polymer E-1 have a degree of neutralization of 91 mol %) was added to the resultant solution, 955 g of deionized water was further added, and stirred with the disper blade at 20° C. for 10 minutes. Next, 300 g of carbon black "Regal-330R" (from Cabot Corporation) was added, and stirred with the disper blade at 6,400 r/min at 20° C. for 2 hours. Subsequently, this was filtered through a 200-mesh filter, and processed for 15 passes under a pressure of 150 MPa using a homogenizer "Microfluidizer M-110EH" (from Microfluidics Corporation). While the resultant dispersion was stirred, methyl ethyl ketone and a part of water were evaporated away at 70° C. under reduced pressure. After cooled, this was filtered through a 200-mesh filter, and deionized water was added to make the solid concentration 20% by mass, thereby giving a colorant particle dispersion Z-1. The volume median particle diameter $D_{50}$ and the CV value of the resultant colorant particles are shown in Table 5.

Production Example Z2

Production of Colorant Particle Dispersion Z-2

A colorant particle dispersion Z-2 was produced in the same manner as in Production Example Z1 except that the colorant to be used was changed to "Hansa Yellow 5GX01" (from Clariant Chemicals Corporation, C.I. Pigment Yellow 74). The volume median particle diameter $D_{50}$ and the CV value of the resultant colorant particles are shown in Table 5.

Production Example Z3

Production of Colorant Particle Dispersion Z-3

A colorant particle dispersion Z-3 was produced in the same manner as in Production Example Z1 except that the colorant to be used was changed to carbon black "Regal-T30R" (from Cabot Corporation). The volume median particle diameter $D_{50}$ and the CV value of the resultant colorant particles are shown in Table 5.

Production Example Z4

Production of Colorant Particle Dispersion Z-4

A colorant particle dispersion Z-4 was produced in the same manner as in Production Example Z1 except that the colorant to be used was changed to carbon black "Regal-T40R" (from Cabot Corporation). The volume median particle diameter $D_{50}$ and the CV value of the resultant colorant particles are shown in Table 5.

Production Example Z5

Production of Colorant Particle Dispersion Z-5

A colorant particle dispersion Z-5 was produced in the same manner as in Production Example Z1 except that the colorant to be used was changed to a yellow pigment "Paliotol Yellow D1155" (from BASF AG, C.I. Pigment Yellow 185). The volume median particle diameter $D_{50}$ and the CV value of the resultant colorant particles are shown in Table 5.

Production Example Z6

Production of Colorant Particle Dispersion Z-6

In the same manner as in Production Example Z1, 75 g of the addition polymer E-1 was dissolved in 630 g of methyl ethyl ketone, and 101 g of an aqueous solution of 5 mass % sodium hydroxide as a neutralizer (to make the addition polymer E-1 have a degree of neutralization of 91 mol %) and 955 g of deionized water were added to the resultant solution, and stirred with the disper blade at 20° C. for 10 minutes. Next, 300 g of carbon black "Regal-330R" (from Cabot Corporation) was added, and stirred with the disper blade at 6,400 r/min at 20° C. for 2 hours.

Subsequently, this was filtered through a 200-mesh filter, and processed for 5 passes with a bead mill "NVM-2" (from Aimex Corporation) using glass beads having a bead size of 0.6 mm, at a filling rate of 80% by volume, at a peripheral speed of 10 m/s and at a flow rate of 0.6 kg/min. While the resultant dispersion was stirred, methyl ethyl ketone and a part of water were evaporated away at 70° C. under reduced pressure. After cooled, this was filtered through a 200-mesh filter, and deionized water was added to make the solid concentration 20% by mass, thereby giving a colorant particle dispersion Z-6. The volume median particle diameter $D_{50}$ and the CV value of the resultant colorant particles are shown in Table 5.

Production Example Z7

Production of Colorant Particle Dispersion Z-7

A colorant particle dispersion Z-7 was produced in the same manner as in Production Example Z1 except that the amount of the addition polymer E-1 used therein was changed to 138 g, the amount of methyl ethyl ketone used therein was changed to 825 g, the amount of aqueous solution of 5 mass % sodium hydroxide used therein was changed to 185 g (to make the addition polymer E-1 have a degree of neutralization of 91 mol %) and the amount of deionized water used therein was changed to 1,198 g. The volume median particle diameter $D_{50}$ and the CV value of the resultant colorant particles are shown in Table 5.

Production Example Z8

Production of Colorant Particle Dispersion Z-8

A colorant particle dispersion Z-8 was produced in the same manner as in Production Example Z1 except that the amount of the addition polymer E-1 used therein was changed to 30 g, the amount of methyl ethyl ketone used therein was changed to 490 g, the amount of aqueous solution of 5 mass % sodium hydroxide used therein was changed to 40 g (to make the addition polymer E-1 have a degree of neutralization of 91 mol %) and the amount of deionized water used therein was changed to 780 g. The volume median particle diameter $D_{50}$ and the CV value of the resultant colorant particles are shown in Table 4.

Production Examples Z9 to Z12

Production of Colorant Particle Dispersions Z-9 to Z-12

Colorant particle dispersions Z-9 to Z-12 were produced in the same manner as in Production Example Z1 except that the addition polymer E-1 was changed to the dispersant species described in Table 5. The volume median particle diameter $D_{50}$ and the CV value of the resultant colorant particles are shown in Table 5.

Production Example Z13

Production of Colorant Particle Dispersion Z-13

75 g of an addition polymer, styrene-acrylic copolymer "Joncryl 690" (from BASF AG; weight-average molecular weight 16,500) was added to a mixture of 103 g of an aqueous 5 mass % solution of sodium hydroxide and 777 g of deionized water, and stirred with a disper blade at 90° C. for 60 minutes. Subsequently, this was cooled down to 20° C., then 300 g of carbon black "Regal-330R" (from Cabot Corporation) was added and stirred with a disper blade at 6,400 r/min and at 20° C. for 2 hours.

Next, this was filtered through a 200-mesh filter and processed for 15 passes under a pressure of 150 MPa using a homogenizer "Microfluidizer M-110EH" (from Microfluidics Corporation). Subsequently, this was filtered through a 200-mesh filter, and deionized water was added to make the solid concentration 20% by mass, thereby giving a colorant particle dispersion Z-13. The volume median particle diameter $D_{50}$ and the CV value of the resultant colorant particles are shown in Table 5.

Production Example Z14

Production of Colorant Particle Dispersion Z-14

A colorant particle dispersion Z-14 was produced in the same manner as in Production Example Z1 except that the addition polymer used therein was changed to 75 g of a styrene-acrylic copolymer "Joncryl 586" (from BASF AG; weight-average molecular weight 4,600), the amount of the aqueous 5 mass % solution of sodium hydroxide used therein was changed to 100 g and the amount of the deionized water used therein was changed to 779 g. The volume median particle diameter $D_{50}$ and the CV value of the resultant colorant particles are shown in Table 5.

Production Example Z51

Production of Colorant Particle Dispersion Z-51

100 g of carbon black "Regal-330R" (from Cabot Corporation), 167 g of an aqueous 15 mass % solution of sodium dodecylbenzenesulfonate "Neopelex G-15" (from Kao Corporation, anionic surfactant), and 102 g of deionized water were mixed in a beaker having an internal volume of 1 L, then dispersed at 20° C. and at a stirring blade rotation speed of 8,000 r/min for 1 hour, using a homomixer "T.K. AGI HOMOMIXER 2M-03" (from PRIMIX Corporation), and processed for 15 passes under a pressure of 150 MPa using a homogenizer "Microfluidizer M-110EH" (from Microfluidics Corporation). Subsequently, this was filtered through a 200-mesh filter, and deionized water was added to make the solid concentration 20% by mass, thereby giving a colorant particle dispersion Z-51. The volume median particle diameter $D_{50}$ and the CV value of the resultant colorant particles are shown in Table 5.

TABLE 5

| | Production Example | | | | | | | |
|---|---|---|---|---|---|---|---|---|
| | Production Example Z1 | Production Example Z2 | Production Example Z3 | Production Example Z4 | Production Example Z5 | Production Example Z6 | Production Example Z7 | Production Example Z8 |
| Colorant Particle Dispersion | Z-1 | Z-2 | Z-3 | Z-4 | Z-5 | Z-6 | Z-7 | Z-8 |
| Colorant | Regal-330 | PY-74 | Regal-T30R | Regal-T40R | PY-185 | Regal-330 | Regal-330 | Regal-330 |
| Addition Polymer E | E-1 | E-1 | E-1 | E-1 | E-1 | E-1 | E-1 | E-1 |
| Ratio by mass of Colorant/Addition Polymer E | 80/20 | 80/20 | 80/20 | 80/20 | 80/20 | 80/20 | 68/32 | 91/9 |
| Disperser | MF | MF | MF | MF | MF | BM | MF | MF |
| Volume Median Particle Diameter $D_{50}$ (μm) | 0.12 | 0.11 | 0.10 | 0.10 | 0.31 | 0.14 | 0.12 | 0.16 |
| CV Value (%) | 29 | 28 | 23 | 23 | 41 | 35 | 29 | 33 |

| | Production Example | | | | | | |
|---|---|---|---|---|---|---|---|
| | Production Example Z9 | Production Example Z10 | Production Example Z11 | Production Example Z12 | Production Example Z13 | Production Example Z14 | Production Example Z51 |
| Colorant Particle Dispersion | Z-9 | Z-10 | Z-11 | Z-12 | Z-13 | Z-14 | Z-51 |
| Colorant | Regal-330 | Regal-330 | Regal-330 | Regal-330 | Regal-330 | Regal-330 | Regal-330 |
| Addition Polymer E | E-2 | E-3 | E-4 | E-5 | 690 | 586 | G-15 |
| Ratio by mass of Colorant/Addition Polymer E | 80/20 | 80/20 | 80/20 | 80/20 | 80/20 | 80/20 | 80/20 |
| Disperser | MF | MF | MF | MF | MF | MF | MF |
| Volume Median Particle Diameter $D_{50}$ (μm) | 0.12 | 0.13 | 0.14 | 0.12 | 0.13 | 0.13 | 0.13 |
| CV Value (%) | 27 | 29 | 30 | 26 | 29 | 27 | 28 |

Regal-330: carbon black "Regal-330R" (from Cabot Corporation), pH 8.6, BET specific surface area 95 $m^2/g$, DBP oil absorption amount 70 ml/100 g Py-74: yellow pigment "Hansa Yellow 5GX01" (from Clariant Chemicals Corporation, C.I. Pigment Yellow 74)

Regal-T30R: carbon black "Regal-T30R" (from Cabot Corporation), pH 6.7, BET specific surface area 70 $m^2/g$ DBP oil absorption amount 38 ml/100 g Regal-T40R: carbon black "Regal-T40R" (from Cabot Corporation), pH 6.8, BET specific surface area 110 $m^2/g$, DBP oil absorption amount 42 ml/100 g PY-185: yellow pigment "Paliotol Yellow D1155" (from BASF AG, C.I. Pigment Yellow 185)

690: styrene-acrylic copolymer Joncryl 690 (weight-average molecular weight 16,500, from BASF AG)

586: styrene-acrylic copolymer Joncryl 586 (weight-average molecular weight 4,600, from BASF AG)

G-15: aqueous solution of sodium dodecylbenzenesulfonate "Neopelex G-15" (from Kao Corporation, anionic surfactant)

MF: "Microfluidizer M-110EH" (from Microfluidics Corporation)

BM: "Bead Mill NVM-2" (from Aimex Corporation)

Production of Toner

Example 1

Production of Toner 1

350 g of the resin particle dispersion X-1, 150 g of the resin particle dispersion Y-1, 56 g of the wax particle dispersion W-1, 28 g of the wax particle dispersion W-2, 78 g of the colorant particle dispersion Z-1, 15 g of an aqueous 10 mass % solution of polyoxyethylene (50) lauryl ether "Emulgen 150" (from Kao Corporation, nonionic surfactant) and 17 g of an aqueous 15 mass % solution of sodium dodecylbenzenesulfonate "Neopelex G-15" (from Kao Corporation, anionic surfactant) were mixed in a four-neck flask having an internal volume of 3 L and equipped with a dewatering tube, a stirrer and a thermocouple, at a temperature of 25° C. Next, with stirring the mixture, a solution prepared by adding an aqueous 4.8 mass % solution of potassium hydroxide to a solution prepared by dissolving 40 g of ammonium sulfate in 568 g of deionized water to adjust the pH of the mixture to 8.6 was dropwise added to the mixture at 25° C. taking 10 minutes, then heated up to 61° C. taking 2 hours, and kept at 61° C. until the volume median particle diameter $D_{50}$ of the aggregated particles could reach 5.2 lam to give a dispersion of aggregated particles.

An aqueous solution prepared by mixing 48 g of sodium polyoxyethylene lauryl ether sulfate "Emal E-27C" (from Kao Corporation, anionic surfactant, effective concentration 27% by mass), 313 g of deionized water, and 40 g of 0.1 mol/L sulfuric acid aqueous solution was added to the resultant aggregated particle dispersion. Subsequently, this was heated up to 75° C. taking 1 hour, then kept at 75° C. for 30 minutes, and 20 g of an aqueous solution of 0.1 mol/L sulfuric acid was added and further kept at 75° C. for 15 minutes. Subsequently, 20 g of an aqueous solution of 0.1 mol/L sulfuric acid was again added and kept at 75° C. until the particles could have a degree of circularity of 0.960, thereby giving a dispersion of coalesced particles formed through coalescing of the aggregated particles.

The resultant coalesced particle dispersion was cooled at 30° C., then the solid fraction was separated through suction filtration, washed with deionized water at 25° C., and filtered through suction filtration at 25° C. for 2 hours. Subsequently, using a vacuum constant-temperature drier "DRV622DA" (from ADVANTEC Corporation), this was dried in vacuum at 33° C. for 24 hours to give toner particles. The amount of the resultant toner particles was 111 g. Since the amount of the toner particles calculated from the charged amounts ("binder resin"+"colorant+addition polymer"+"wax+resin used for wax dispersion") is 132 g, the toner yield is 84%. The properties of the resultant toner particles are shown in Table 6.

100 parts by mass of the toner particles, 2.5 parts by mass of hydrophobic silica "RY50" (from Nippon Aerosil Co., Ltd., number-average particle size: 0.04 lam) and 1.0 part by mass of hydrophobic silica "Cabosil (registered trademark) TS720" (from Cabot Japan Co., Ltd., number-average particle size: 0.012 μm) were put into a Henschel mixer and stirred, then filtered through a 150-mesh sieve to give a toner 1. The properties of the resultant toner and the evaluation results thereof are shown in Table 6.

Examples 2 to 6, 9 to 21 and Comparative Examples 1 to 2

Production of Toners 2 to 6, 9 to 21, 51 to 52

Toners 2 to 6, 9 to 21, 51 to 52 were produced in the same manner as in Example 1, except that the kind of the resin particle dispersion and the kind of the colorant particle dispersion to be used were changed as in Table 6. The properties of the resultant toner particles, the toner yield and the evaluation results of the toners are shown in Table 6.

Example 7

Production of Toner 7

A toner 7 was produced in the same manner as in Example 1 except that the kind of the colorant particle dispersion to be used was changed to the colorant particle dispersion Z-7 and the amount thereof to be added was changed to 92 g. The properties of the resultant toner particles, the toner yield and the evaluation results of the toner are shown in Table 6.

Example 8

Production of Toner 8

A toner 8 was produced in the same manner as in Example 1 except that the kind of the colorant particle dispersion to be used was changed to the colorant particle dispersion Z-8 and the amount thereof to be added was changed to 69 g. The properties of the resultant toner particles, the toner yield and the evaluation results of the toner are shown in Table 6.

Example 22

Production of Toner 22

A toner 22 was produced in the same manner as in Example 1 except that the resin particle dispersion X-1 and the resin particle dispersion Y-1 to be used was changed to the resin particle dispersion XY-1, and the amount thereof to be added was to 500 g. The properties of the resultant toner particles, the toner yield and the evaluation results of the toner are shown in Table 6.

TABLE 6

| | | | Example 1 | Example 2 | Example 3 | Example 4 | Example 5 | Example 6 | Example 7 | Example 8 |
|---|---|---|---|---|---|---|---|---|---|---|
| Toner | | | 1 | 2 | 3 | 4 | 5 | 6 | 7 | 8 |
| Resin Particles | Resin Particle Dispersion 1 | Dispersion No. | X-1 | X-1 | X-1 | X-1 | X-1 | X-1 | X-1 | X-1 |
| | | Amount (part by mass) | 70 | 70 | 70 | 70 | 70 | 70 | 70 | 70 |
| | Resin Particle Dispersion 2 | Dispersion No. | Y-1 | Y-1 | Y-1 | Y-1 | Y-1 | Y-1 | Y-1 | Y-1 |
| | | Amount (part by mass) | 30 | 30 | 30 | 30 | 30 | 30 | 30 | 30 |
| Colorant Particles | Colorant Particle Dispersion | | Z-1 | Z-2 | Z-3 | Z-4 | Z-5 | Z-6 | Z-7 | Z-8 |
| | Colorant | | Regal-330 | PY-74 | Regal-T30R | Regal-T40R | PY-185 | Regal-330 | Regal-330 | Regal-330 |

TABLE 6-continued

| | | | | | | | | | |
|---|---|---|---|---|---|---|---|---|---|
| | Addition Polymer | E-1 | E-1 | E-1 | E-1 | E-1 | E-1 | E-1 | E-1 |
| | Ratio by mass of Colorant/Addition Polymer | 80/20 | 80/20 | 80/20 | 80/20 | 80/20 | 80/20 | 68/32 | 91/9 |
| | Disperser | MF | MF | MF | MF | MF | BM | MF | MF |
| Properties | Volume Median Particle Diameter $D_{50}$ of Toner Particles (μm) | 5.0 | 5.0 | 5.0 | 5.0 | 5.1 | 5.0 | 4.9 | 5.0 |
| | CV Value of Toner Particles (%) | 22 | 22 | 21 | 22 | 31 | 22 | 21 | 24 |
| Evaluation | Toner Yield (%) | 84 | 86 | 88 | 87 | 78 | 80 | 83 | 79 |
| | Image Density of Print (toner deposition amount 0.25 mg/cm$^2$) | 1.47 | 1.45 | 1.45 | 1.50 | 1.33 | 1.43 | 1.44 | 1.42 |

| | | | Example 9 | Example 10 | Example 11 | Example 12 | Example 13 | Example 14 | Example 15 | Example 16 |
|---|---|---|---|---|---|---|---|---|---|---|
| | Toner | | 9 | 10 | 11 | 12 | 13 | 14 | 15 | 16 |
| Resin Particles | Resin Particle Dispersion 1 | Dispersion No. | X-1 | X-1 | X-1 | X-1 | X-1 | X-1 | X-1 | X-2 |
| | | Amount (part by mass) | 70 | 70 | 70 | 70 | 70 | 70 | 85 | 70 |
| | Resin Particle Dispersion 2 | Dispersion No. | Y-1 | Y-1 | Y-1 | Y-1 | Y-1 | Y-1 | Y-1 | Y-1 |
| | | Amount (part by mass) | 30 | 30 | 30 | 30 | 30 | 30 | 15 | 30 |
| Colorant Particles | Colorant Particle Dispersion | | Z-9 | Z-10 | Z-11 | Z-12 | Z-13 | Z-14 | Z-1 | Z-1 |
| | Colorant | | Regal-330 | Regal-330 | Regal-330 | Regal-330 | Regal-330 | Regal-330 | Regal-330 | Regal-330 |
| | Addition Polymer | | E-2 | E-3 | E-4 | E-5 | 690 | 586 | E-1 | E-1 |
| | Ratio by mass of Colorant/Addition Polymer | | 80/20 | 80/20 | 80/20 | 80/20 | 80/20 | 80/20 | 80/20 | 80/20 |
| | Disperser | | MF | MF | MF | MF | MF | MF | MF | MF |
| Properties | Volume Median Particle Diameter $D_{50}$ of Toner Particles (μm) | | 5.0 | 5.0 | 5.0 | 5.0 | 5.0 | 5.0 | 5.1 | 5.0 |
| | CV Value of Toner Particles (%) | | 22 | 21 | 24 | 22 | 23 | 22 | 24 | 22 |
| Evaluation | Toner Yield (%) | | 86 | 81 | 75 | 84 | 82 | 84 | 85 | 83 |
| | Image Density of Print (toner deposition amount 0.25 mg/cm$^2$) | | 1.45 | 1.44 | 1.41 | 1.44 | 1.39 | 1.35 | 1.40 | 1.44 |

| | | | Example 17 | Example 18 | Example 19 | Example 20 | Example 21 | Example 22 | Comparative Example 1 | Comparative Example 2 |
|---|---|---|---|---|---|---|---|---|---|---|
| | Toner | | 17 | 18 | 19 | 20 | 21 | 22 | 51 | 52 |
| Resin Particles | Resin Particle Dispersion 1 | Dispersion No. | X-3 | X-4 | X-5 | X-1 | X-1 | XY-1 | X-1 | X-1 |
| | | Amount (part by mass) | 70 | 70 | 70 | 70 | 70 | 100 | 70 | 100 |
| | Resin Particle Dispersion 2 | Dispersion No. | Y-1 | Y-1 | Y-1 | Y-2 | Y-3 | — | Y-1 | — |
| | | Amount (part by mass) | 30 | 30 | 30 | 30 | 30 | — | 30 | — |
| Colorant Particles | Colorant Particle Dispersion | | Z-1 | Z-1 | Z-1 | Z-1 | Z-1 | Z-1 | Z-51 | Z-1 |
| | Colorant | | Regal-330 | Regal-330 | Regal-330 | Regal-330 | Regal-330 | Regal-330 | Regal-330 | Regal-330 |
| | Addition Polymer | | E-1 | E-1 | E-1 | E-1 | E-1 | E-1 | G-15 | E-1 |
| | Ratio by mass of Colorant/Addition Polymer | | 80/20 | 80/20 | 80/20 | 80/20 | 80/20 | 80/20 | 80/20 | 80/20 |
| | Disperser | | MF | MF | MF | MF | NW | MF | MF | MF |
| Properties | Volume Median Particle Diameter $D_{50}$ of Toner Particles (μm) | | 5.0 | 5.1 | 5.0 | 5.0 | 5.0 | 5.0 | 5.0 | 5.0 |
| | CV Value of Toner Particles (%) | | 23 | 23 | 21 | 21 | 24 | 22 | 24 | 22 |
| Evaluation | Toner Yield (%) | | 85 | 84 | 85 | 82 | 84 | 85 | 64 | 83 |
| | Image Density of Print (toner deposition amount 0.25 mg/cm$^2$) | | 1.44 | 1.41 | 1.34 | 1.47 | 1.43 | 1.46 | 0.88 | 1.25 |

Regal-330: carbon black "Regal-330R" (from Cabot Corporation), pH 8.6, BET specific surface area 95 m$^2$/g. DBP oil absorption amount 70 ml/100 g
PY-74: yellow pigment "Hansa Yellow 5GX01" (from Clariant Chemicals Corporation, C.I. Pigment Yellow 74)
Regal-T30R: carbon black "Regal-T30R" (from Cabot Corporation), pH 6.7, BET specific surface area 70 m$^2$/g, DBP oil absorption amount 38 ml/100 g
Regal-T40R: carbon black "Regal-T40R" (from Cabot Corporation), pH 6.8, BET specific surface area 110 m$^2$/g, DBP oil absorption amount 42 ml/100 g
PY-185: yellow pigment "Paliotol Yellow D1155" (from BASF AG, C.I. Pigment Yellow 185)
690: styrene-acrylic copolymer Joncryl 690 (weight-average molecular weight 16,500, from BASF AG)
586: styrene-acrylic copolymer Joncryl 586 (weight-average molecular weight 4,600, from BASF AG)
G-15: aqueous solution of sodium dodecylbenzenesulfonate "Neopelex G-15" (from Kao Corporation, anionic surfactant)
MF: "Microfluidizer M-110EH" (from Microfluidics Corporation)
BM: "Bead Mill NVM-2" (from Aimex Corporation)

Example 1 and Comparative Example 2 were tested to evaluate the standard paper contrast ratio. The results are shown in Table 7.

TABLE 7

| | | Example 1 | Comparative Example 2 |
|---|---|---|---|
| | Toner | 1 | 52 |
| Evaluation | Standard paper contrast ratio (%) | 96.4 | 92.4 |

As hereinabove, from the results of Examples and Comparative Examples, it is known that, according to the present invention, there can be obtained a toner capable of providing prints having a high image density at a high yield. Further, according to the present invention, there can be obtained images having a high standard paper contrast ratio.

The invention claimed is:

1. A method for producing a toner, comprising:

aggregating and coalescing resin particles and colorant particles in an aqueous medium to form coalesced particles, wherein in the aggregating and coalescing resin particles and colorant particles, adding an aggregating agent in an amount of from 5 parts by mass to 50 parts by mass, relative to the total amount 100 parts by mass of resins, each resin particle comprises an amorphous polyester-based resin which is a composite resin comprising a polyester resin segment being a polycondensate of an alcohol component comprising an aromatic alcohol and a carboxylic acid component, an addition polymer resin segment being an addition polymer of a raw material monomer comprising a styrenic compound, and a structural unit derived from a bireactive monomer bonding to the polyester resin segment and the addition polymer resin segment via a covalent bond, and a crystalline polyester resin, wherein each resin particle is formed by mixing the amorphous polyester-based resin and the crystalline polyester resin, or by mixing a particle comprising the amorphous polyester-based resin and a particle comprising the crystalline polyester resin, the colorant particles comprise a carbon black and an addition polymer of a raw material monomer comprising a styrene and an addition-polymerizing monomer comprising a polyalkylene oxide group, wherein a pH value of the carbon black is from 5 to 6.8, an amount of the styrene in the raw material monomer for the addition polymer in the colorant particles is at least 30% by mass, and a ratio by mass of the carbon black to the addition polymer in the colorant particles is from 50/50 to 95/5, and a degree of circularity of the coalesced particle is from 0.960 to 0.990.

2. The method for producing a toner according to claim 1, wherein the crystalline polyester resin is a polycondensate of an alcohol component comprising an α,ω-aliphatic diol and a carboxylic acid component.

3. The method for producing a toner according to claim 1, wherein the raw material monomer for the addition polymer in the colorant particles further comprises an addition-polymerizing monomer having an anionic group.

4. The method for producing a toner according to claim 1, wherein the colorant particles are obtained by a method comprising:

(a) mixing the addition polymer and an organic solvent, and further mixing with an aqueous medium to obtain a dispersion of the addition polymer, and (b) dispersing the dispersion prepared in (a) with the carbon black to obtain a dispersion of the colorant particles.

5. The method for producing a toner according to claim 4, wherein in (b), the dispersion obtained in (a) and the carbon black are dispersed with a bead mill or a homogenizer.

6. The method for producing a toner according to claim 1, wherein a volume median particle diameter $D_{50}$ of the colorant particles is from 0.05 μm to 0.4 μm.

7. The method for producing a toner according to claim 1, wherein the amount of the colorant particles is from 3 parts by mass to 40 parts by mass relative to 100 parts by mass of the resin particles.

8. The method for producing a toner according to claim 1, wherein a mass ratio of the crystalline polyester resin to the amorphous polyester-based resin, crystalline polyester resin/amorphous polyester-based resin, is from 1/99 to 50/50.

9. The method for producing a toner according to claim 1, wherein the amorphous polyester-based resin comprises a structural unit derived from a hydrocarbon wax (W1) having at least one group selected from the group consisting of a carboxy group and a hydroxy group.

10. The method for producing a toner according to claim 1, wherein an amount of a tribasic or higher polycarboxylic acid in the carboxylic acid component is from 3 mol % to 30 mol %.

11. The method for producing a toner according to claim 2, wherein a carbon number of the α,ω-aliphatic diol is from 4 to 16.

12. The method for producing a toner according to claim 1, wherein a softening point of the crystalline polyester resin is from 60° C. to 150° C.

13. The method for producing a toner according to claim 3, wherein an amount of the addition-polymerizing monomer having an anionic group in the raw material monomer for the addition polymer in the colorant particles is from 2% by mass to 40% by mass.

14. The method for producing a toner according to claim 1, wherein a softening point of the amorphous polyester-based resin is from 70° C. to 140° C.

15. The method for producing a toner according to claim 1, wherein the raw material monomer for the addition polymer in the colorant particles further comprises a macromonomer.

16. The method for producing a toner according to claim 1, wherein the carbon black has a dibutyl phthalate oil absorption amount of from 20 ml/100 g to 50 ml/100 g.

* * * * *